US005487682A

United States Patent [19]

Miller et al.

[11] Patent Number: 5,487,682

[45] Date of Patent: Jan. 30, 1996

[54] SHIELDED DATA CONNECTOR

[75] Inventors: Mitchell E. Miller, Clemmons; Julian J. Ferry, Kernersville, both of N.C.; Brian E. Kilbey, Chesham, England; Bruce S. Coolbear, East Barnet, England; Richard F. Gandy, St. Albans, England

[73] Assignee: The Whitaker Corporation, Wilmington, Del.

[21] Appl. No.: 479,250

[22] Filed: Jun. 7, 1995

Related U.S. Application Data

[63] Continuation of Ser. No. 101,529, Aug. 3, 1993, abandoned, which is a continuation-in-part of Ser. No. 941,526, Sep. 8, 1992, abandoned.

[30] Foreign Application Priority Data

| | | | |
|---|---|---|---|
| Nov. 3, 1992 | [GB] | United Kingdom | 9222960 |
| Dec. 29, 1992 | [GB] | United Kingdom | 9227064 |
| Feb. 22, 1993 | [GB] | United Kingdom | 9303502 |

[51] Int. Cl.[6] ..... H01R 13/648

[52] U.S. Cl. ..... 439/607; 439/608

[58] Field of Search ..... 439/92, 101, 108, 439/607, 608, 609, 610, 701

[56] References Cited

U.S. PATENT DOCUMENTS

| | | | |
|---|---|---|---|
| 4,501,459 | 2/1985 | Chandler et al. . | |
| 4,598,969 | 7/1986 | Stephenson | 439/608 |
| 4,846,727 | 7/1989 | Glover et al. | 439/608 |
| 4,974,075 | 11/1990 | Nakajima | 439/607 X |
| 4,975,084 | 12/1990 | Fedder et al. | 439/608 |
| 5,009,616 | 4/1991 | Fogg et al. | 439/608 |
| 5,066,236 | 11/1991 | Broeksteeg | 439/79 |
| 5,135,405 | 8/1992 | Fusselman et al. | 439/608 X |
| 5,328,380 | 7/1994 | Carney | 439/188 |

FOREIGN PATENT DOCUMENTS

| | | |
|---|---|---|
| 0107288 | 8/1983 | European Pat. Off. . |
| 0122711 | 12/1983 | European Pat. Off. . |
| 0268441 | 11/1987 | European Pat. Off. . |
| 0422785 | 9/1990 | European Pat. Off. . |
| 0610088 | 2/1994 | European Pat. Off. . |
| WO8605311 | 3/1986 | WIPO . |
| WO8606553 | 3/1986 | WIPO . |

OTHER PUBLICATIONS

European Search Report.

*Primary Examiner*—Khiem Nguyen

*Attorney, Agent, or Firm*—Eric J. Groen; Driscoll A. Nina, Jr.

[57] ABSTRACT

An electrical shielded data connector includes an inner terminal support housing (4, 404, 520) carrying a plurality of electrical terminals such as (30, 560) where the terminal support housing includes shield members (130, 160; 330, 360; 460; 516, 518) surrounding the terminal support housing (4, 404, 520). The shielded sub-assembly is insertable into an outer housing (70; 512, 514) and is latchably attached therein and a rear support plate (95) and cable support member (110) can be assembled around a cable after the termination of the multi-conductor cable. The cable support member (110) can be positioned in one of two orientations to provide for either a straight through or an angled cable exit. A cross talk shield (200, 524) is positioned in a stuffer cap (180, 522) and is situated between adjacent terminals (30, 560) when in the final position. Another cross talk shield (220, 320) is positioned in a slot (50, 450) intermediate the terminals (30) at the lower side thereof.

24 Claims, 24 Drawing Sheets

512
615b
623a
584
582
580
584
516
570
572
586
574
586
578
576
586
524
622
522
528
532
620
500
530
550
548
536
554
560
520
534
546
558
616
544
552
556
540
542
614
526
594
600
518
610
608
590
598
608
604
596
612
602
592
623
617a
615a
514
619
623b

SHIELDED DATA CONNECTOR

CROSS REFERENCE TO RELATED APPLICATION

This application is a Continuation of application Ser. No. 08/101,529 filed Aug. 3, 1993, now abandoned, in turn, which is a Continuation-in-Part of Application Ser. No. 07/941,526 filed Sep. 8, 1992, now abandoned.

FIELD OF THE INVENTION

The subject invention relates to an improved shielded data connector for use in local area network connections.

BACKGROUND OF THE INVENTION

U.S. Pat. No. 4,501,459 discloses a local area network connector specifically for use in the data communications industry. These connectors can be employed in a closed loop data communications link in which various equipment such as computer terminals can be interconnected in a system. These connectors are specifically adapted for use in interconnecting numerous micro or mini computers in a micro computer network in an office environment. Connectors of this type have standard interface dimensions and configurations. These connectors must also be shielded to prevent the spurious electrical signals and noise from affecting the signals in the network. These connectors also require a shunting capability since the conductors are part of a network and can be connected in series with other similar connectors. This shunting capability is necessary to prevent disruption of a network when an individual plug is not connected to external equipment.

The structure and components of local area network connectors of this type is represented by the structure of the connectors shown in the before mentioned U.S. Pat. No. 4,501,459. These connectors include a plurality of spring metal terminals having insulation displacement wire barrels for establishing electrical connection with the individual conductors forming the multi-conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to cover the upper and lower shields to the cable shielding.

The above mentioned conventional shielded electrical connectors provide for shielding around the connector, to prevent adverse interference from exterior to the connector to signals being conducted within the connector. Such connectors have been widely used. Conventional connectors, however, do not address the possibility of signal cross-talk proximate the termination of each conductor, when the twisted pairs are no longer intertwined. Accordingly, while conventional connectors guard against signal interference from outside the connector, they do not include provisions for controlling cross-talk between signal conductors inside the connector.

In the conventional connector systems, four positions are established by four electrical terminals having wire connecting sections interconnected to the mating contact portions. Generally, two twisted pairs of conductors are interconnected to the terminals at the wire connecting sections, by untwisting the pairs for a short distance at their ends. As is well known, the twisting of the pairs eliminates cross talk between the signal pairs due to the inductance balance, thus, untwisting for a short distance eliminates the cross talk compensation provided by the twisting. The untwisting causes no problems at low frequency signals, but could cause interference between the pairs at higher frequencies.

SUMMARY OF THE INVENTION

It is an object of the invention then to provide a low cost shielded data connector where the assembly includes adequate EMI/RFI protection, as well as cross talk protection between the adjacent pair of signal contacts.

The objects of the invention have been accomplished by providing an electrical connector having an insulating housing carrying a plurality of electrical terminals where the terminals include a contact portion and a wire termination portion. The wire termination portion comprises a slot within a metal plate for insulation piercing electrical connection with the insulation wire and a stuffer cap for receiving more than one insulated wire where the cap is insertable over the wire termination portion for electrically connecting the wires to the terminal. The connector is characterized in that stuffer cap has a plate like member positioned intermediate at least two of the openings providing shielding between adjacent wires.

BRIEF DESCRIPTION OF THE DRAWINGS

Preferred embodiments of the electrical connector will now be described by way of example with reference to the accompanying drawings, in which.

DETAILED DESCRIPTION OF THE INVENTION

Figure 1:
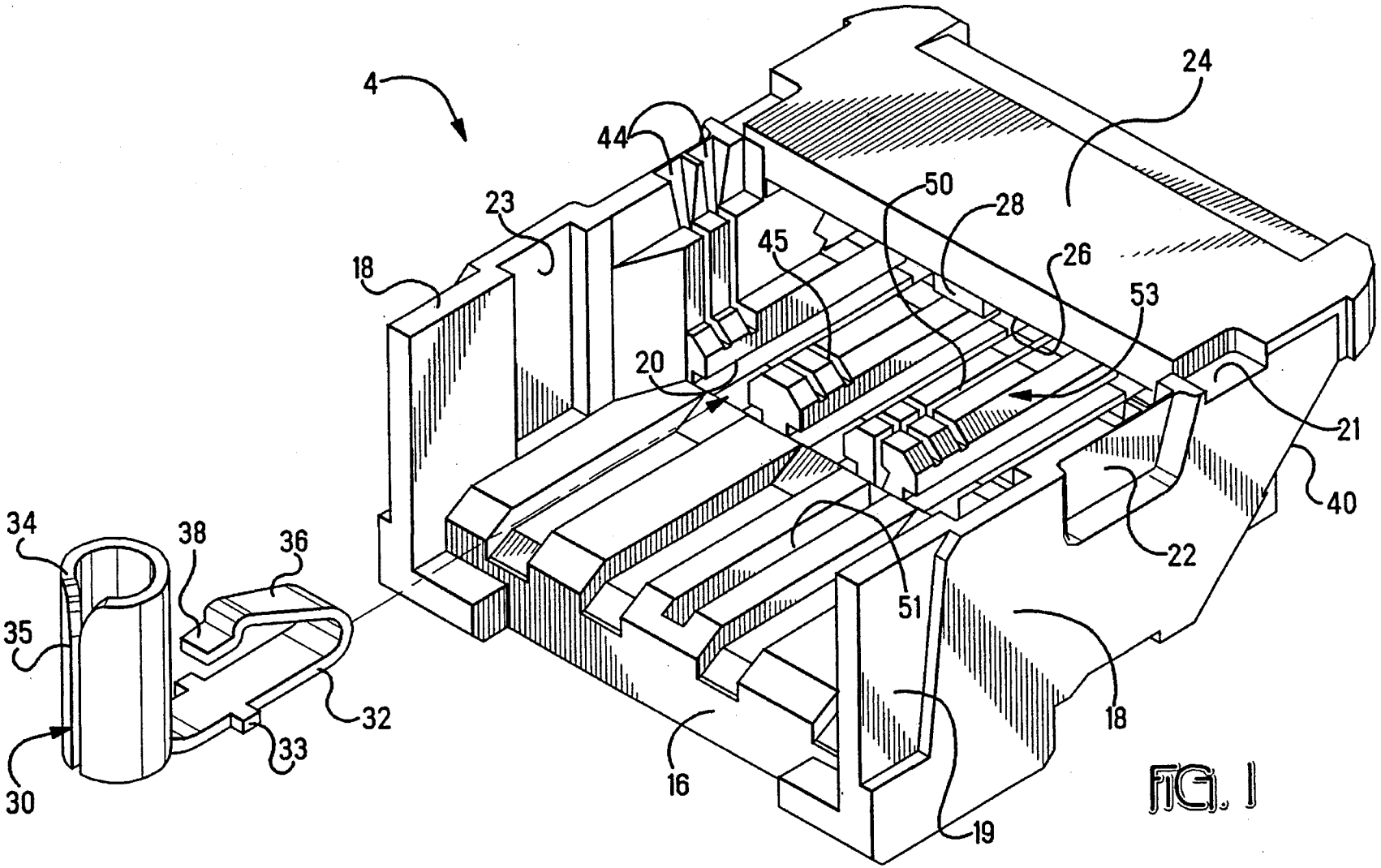
FIG. 1 is an isometric view of the inner terminal support housing showing one of the terminals exploded away from the housing.
Figure 2:
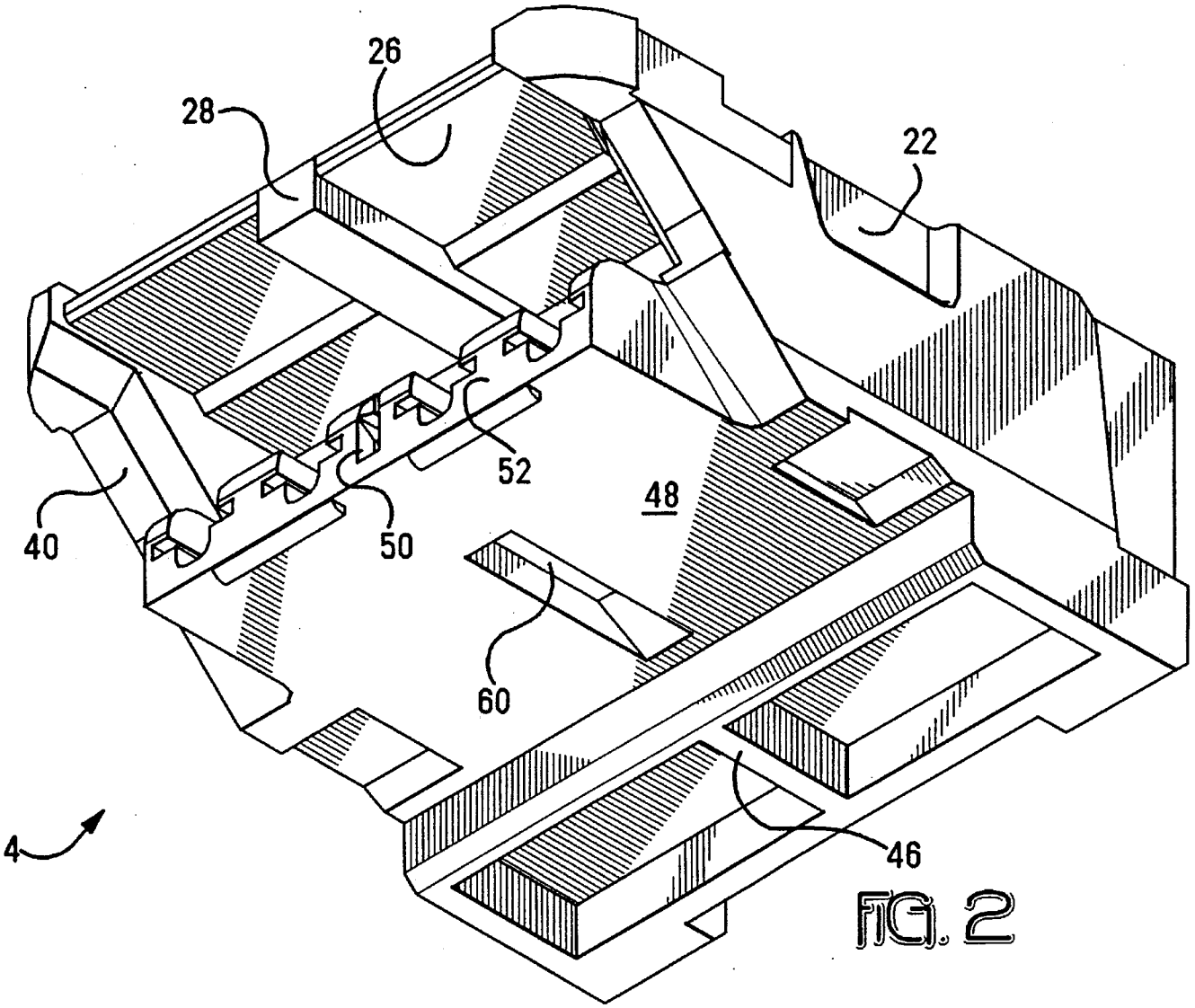
FIG. 2 is a lower isometric view of the terminal support housing.

With reference now to FIG. 1, the inner insulative housing 4 is shown as comprising a terminal support platform portion 16 having upstanding side walls 18, having recessed sections 19, where the terminal support platform 16 includes a plurality of terminal receiving slots at 20, and where the outer surfaces of the side walls 18 include notched portions 22.. A hood portion 24 is shown spanning and interconnecting the two side walls 18 where the lower surface 26 of the hood portion 24 is interrupted by a longitudinally extending rib at 28 (FIGS. 1 and 2). Terminals 30 are shown as comprising a base portion 32 having a wire barrel portion 34 extending from one end thereof having a slot 35 for receiving a wire in insulation displacement relation, and a contact portion 36 extending from the opposite end of the base portion 32, where the contact portion has a stepped portion extending from the free end thereof. The terminal 30 also includes side tab portions 33 for positioning the terminals as will be described herein.

Figure 3:
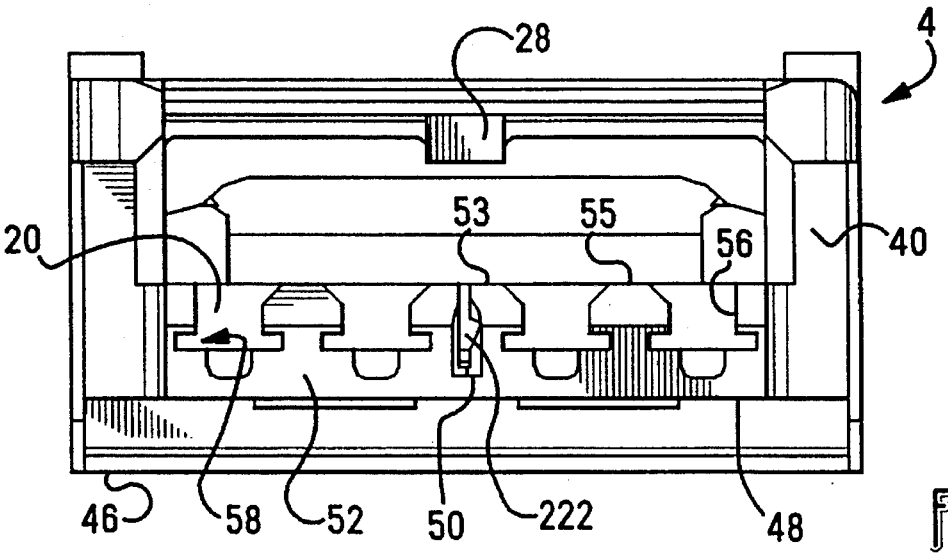
FIG. 3 is a front plan view of the housing member shown in FIGS. 1 and 2.
Figure 26:
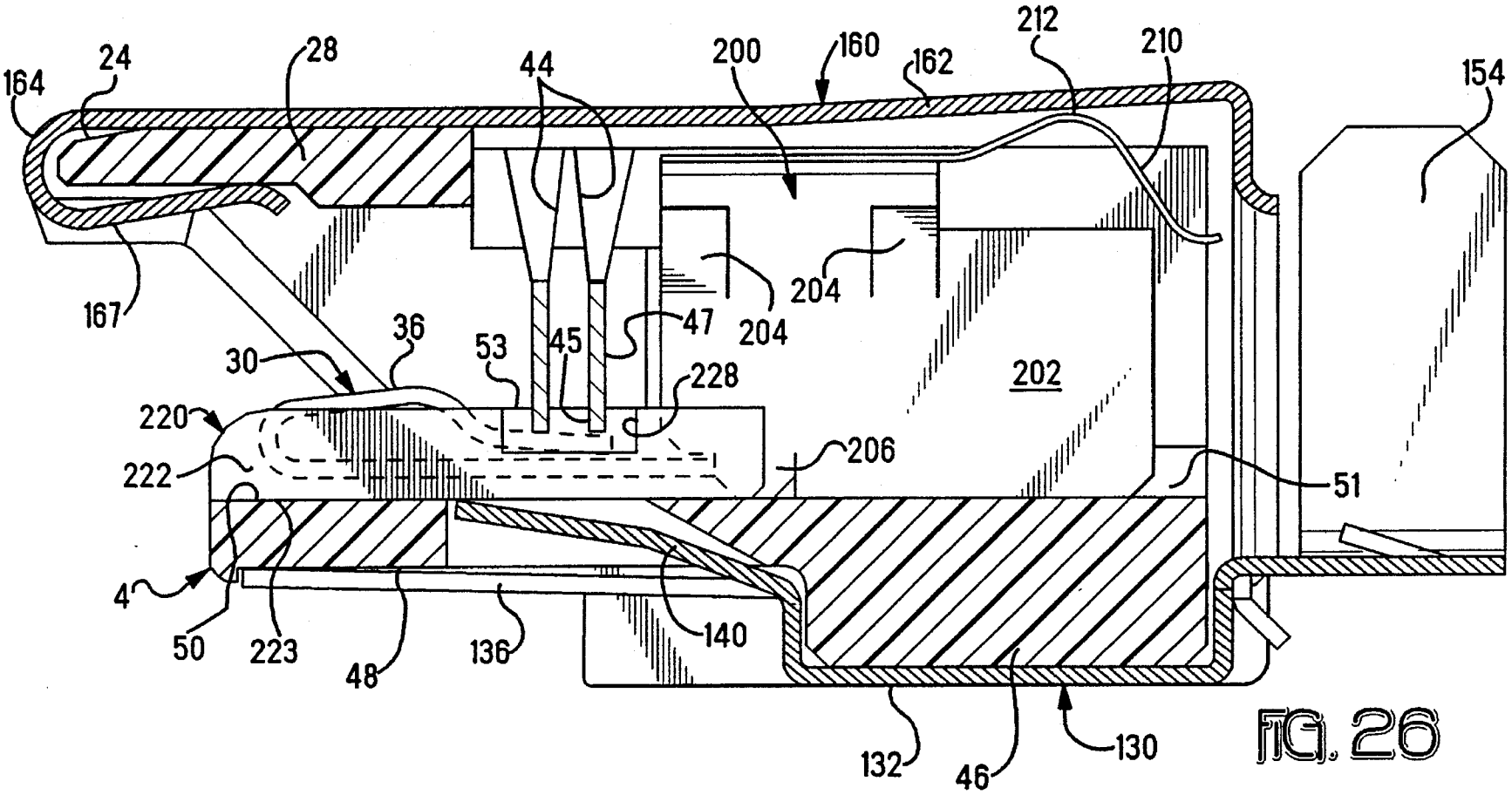
FIG. 26 is a cross-sectional view showing the cooperation of the cross talk shields with the associated upper and lower shield.

The terminal 30 is slidably receivable into a respective terminal receiving slot 20 (FIG. 3) to a position where the contact portions 36 are adjacent to a front mating edge 40 of the terminal support housing 4, and positioned for mating interconnection with a complementary connector. The terminal support housing 4 further includes two slots 44 in which shunt bars which span the electrical terminals 30 and selectively contact the stepped portions 38 of alternate terminals to provide a closed loop electrical connection as shown in FIG. 26 which is more fully disclosed in U.S. Pat. No. 4,501,459. As shown in FIG. 3, the terminal support housing 4 further includes a lower insulative block portion 46 positioned on a lower surface 48 of the terminal support housing.

Figure 4:
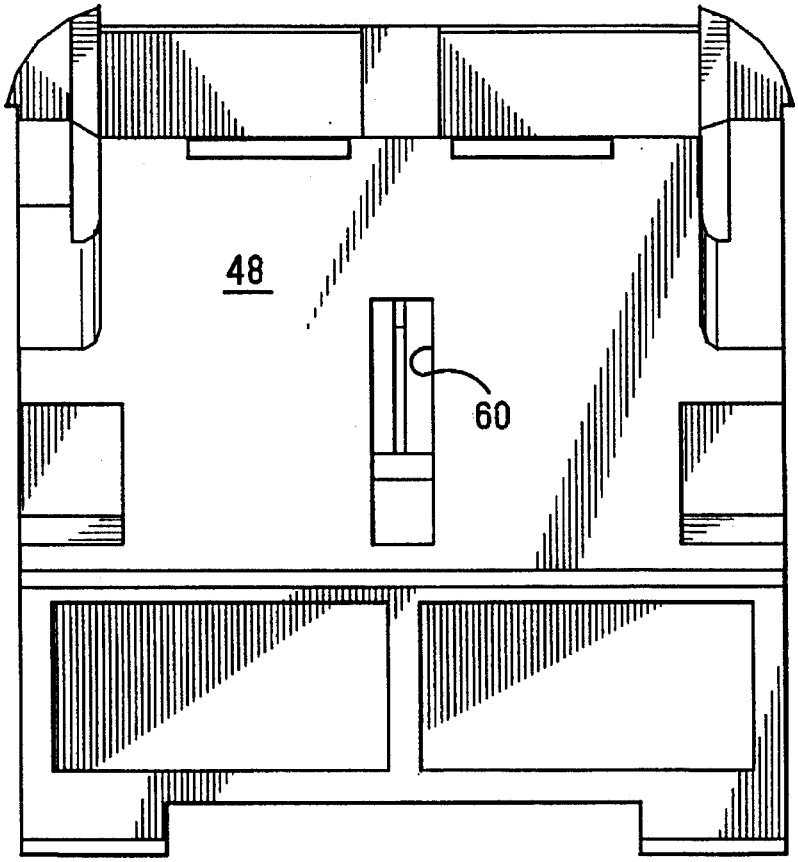
FIG. 4 is a lower plan view of the housing shown in FIG. 1–3.

As best shown in FIGS. 2 and 3, a channel 50 extends rearwardly through the front edge 52 of the housing member extending through the terminal platform portion 53, and is coincidental with channel portion 51 in the rear platform portion 16. Two other platforms 54 and 55 (FIG. 3) extend on opposite sides of the central platform 53 and together with side wall portions 56 form the slots 20 having T-shaped openings 58 for receipt of the terminal base portions 32 including their side tabs 33 (FIG. 1). As best shown in FIGS. 2 and 4, a window 60 extends through the lower surface 48 and extends upwardly deep enough to intersect with the slot 50 through the platform 53 as will be described in greater detail herein.

Figure 5:
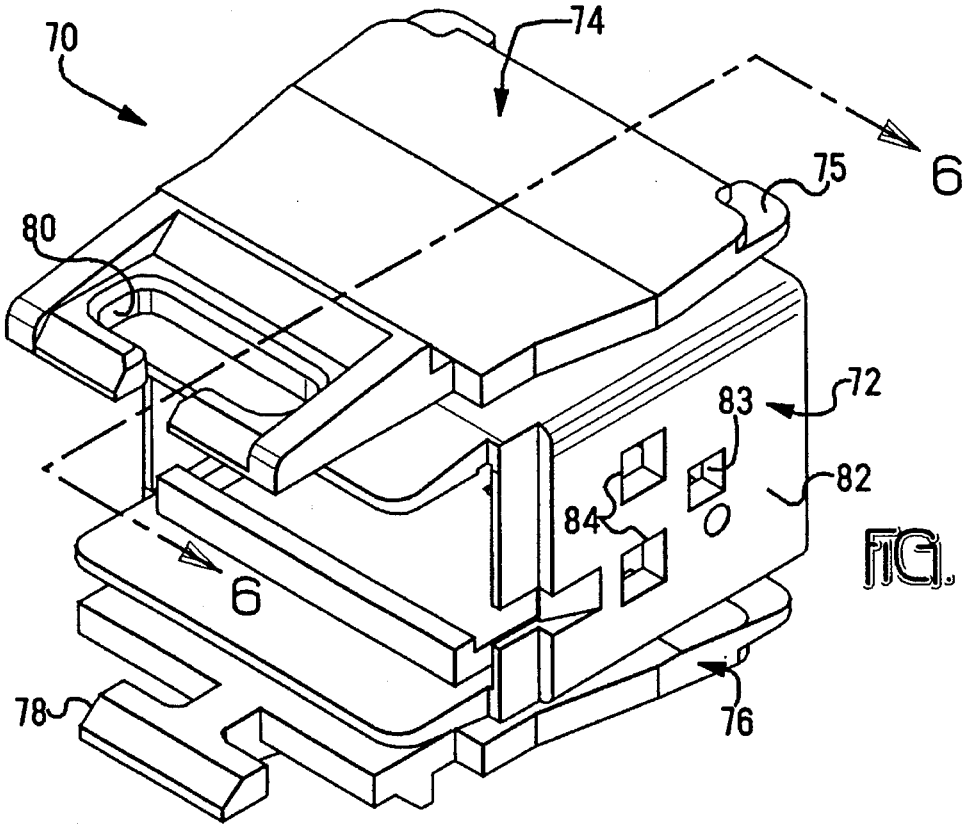
FIG. 5 is an isometric view showing an outer housing for use with the housing shown in FIG. 1–4.
Figure 6:
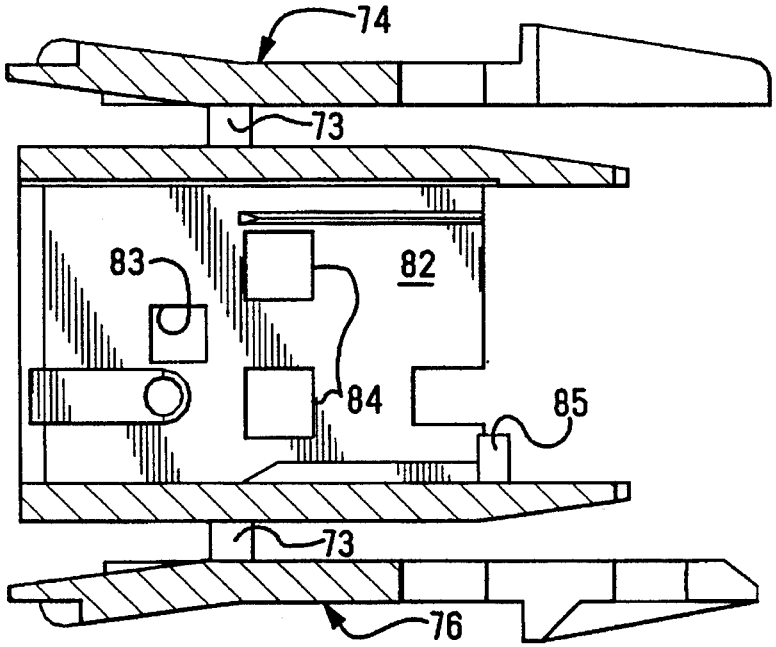
FIG. 6 is a cross-sectional view through lines 5—5 of FIG. 5.

With reference now to FIGS. 5 and 6, the outer housing portion 70 includes a housing body portion 72 having upper and lower latch plates 74,76 attached thereto by way of an integral molded web allowing the latching plates to pivot about a transverse axis. It should be noted that the latching plates 74 and 76 include hermaphroditic latching elements 78 and 80 which are conventional for this type of electrical data connector. As shown best in FIG. 5, the body portion 72 includes a side wall 82 having openings 83 and 84 extending therethrough which are used for latching structures, as will be described in greater detail herein.

Figure 7:
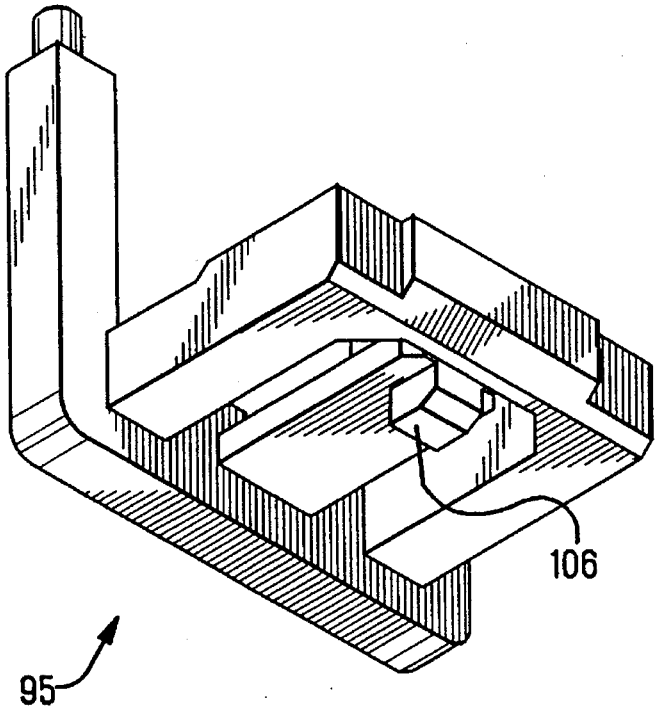
FIGS. 7 and 8 are isometric views of the backplate of the present invention.
Figure 8:
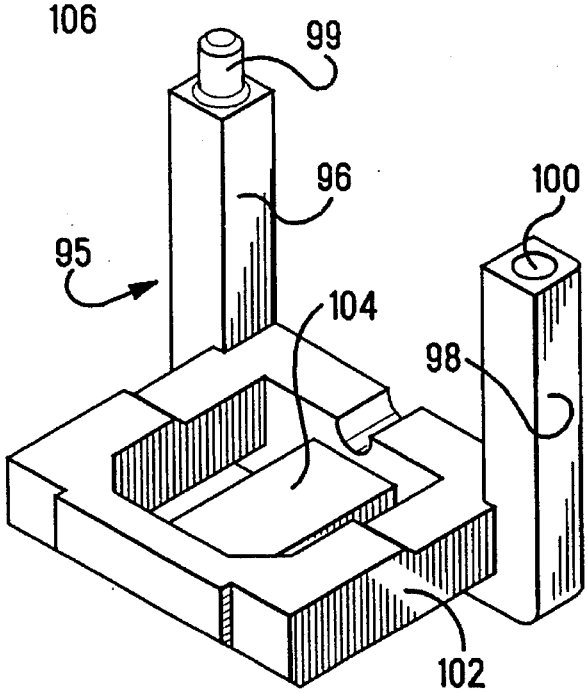
Figure 9:
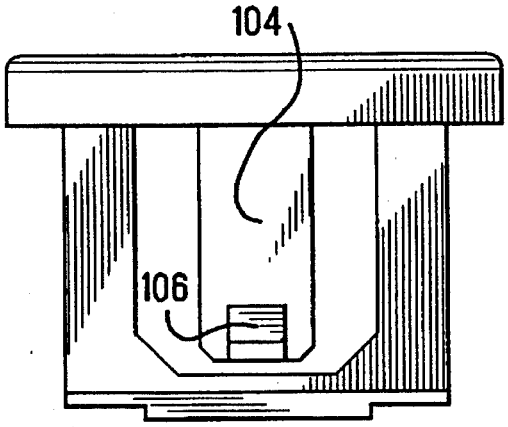
FIG. 9 is a side plan view of the backplate member shown in FIGS. 7 and 8.

With reference now to FIGS. 7–9, a rear plate portion 95 includes frame support members 96 and 98 where the frame support member 96 includes a peg 99 and the support member 98 includes a complementary hole 100 for the peg 99. It should be appreciated that these support members 95 are profiled such that another identical support member 95 can be connected above the support member shown in FIG. 8 and snapped together by way of the pegs 99 and holes 100. Side plates 102 are located intermediate the support members 96 and 98 and provide a latching arm 104 having an outwardly extending latching lug 106.

Figure 11:
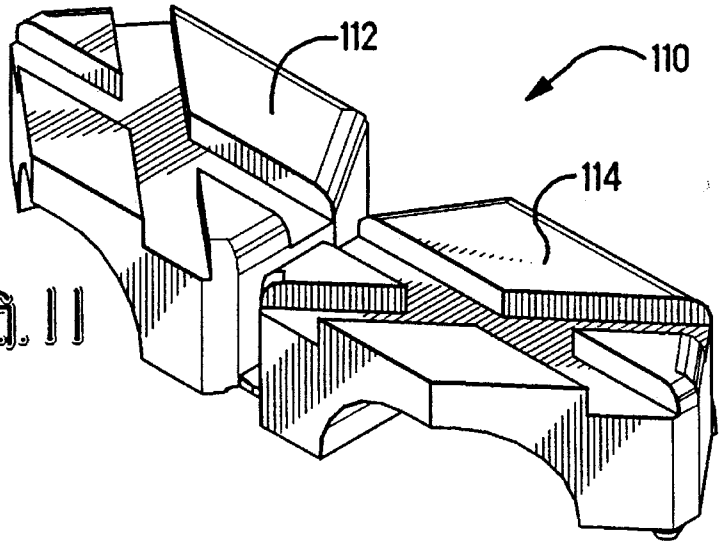
FIGS. 10 and 11 are isometric views of the cable strain relief member used with the backplate of FIGS. 7 and 8.
Figure 10:
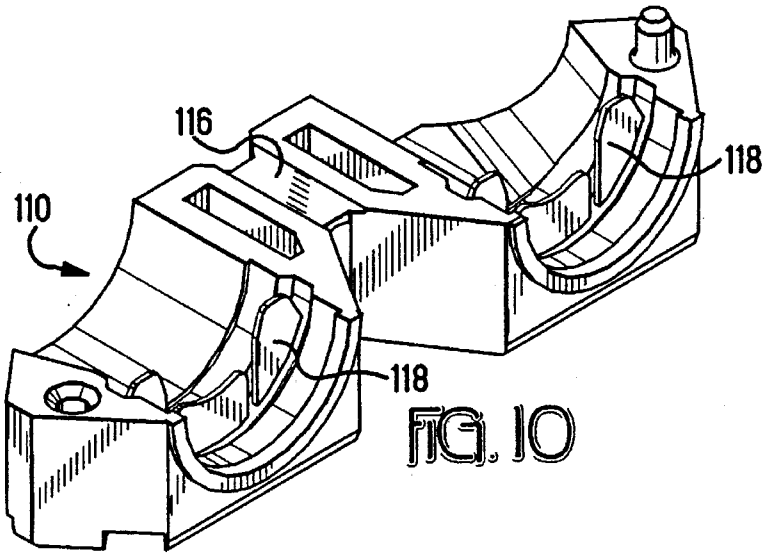
Figure 12:
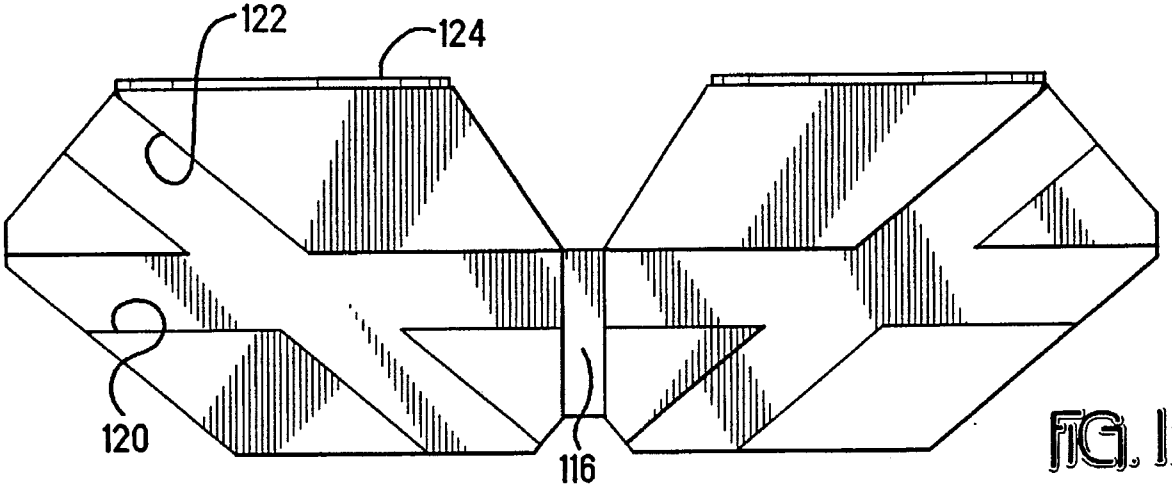
FIG. 12 is a side plan view of the strain relief member shown in FIG. 11.

With reference now to FIGS. 10–12, the cable strain relief member at 110 includes halves 112 and 114 integrally molded together by way of a web of material 116 at the lower edge. Each of the strain relief members include flexible inner fingers 118 for compressibly gripping the cable to hold the cable from axial strain. The outer surfaces of the strain relief member includes two slots 120 and 122 which cooperate with the support members 96 and 98 to project the opening 124 in alternate directions.

Figure 13:
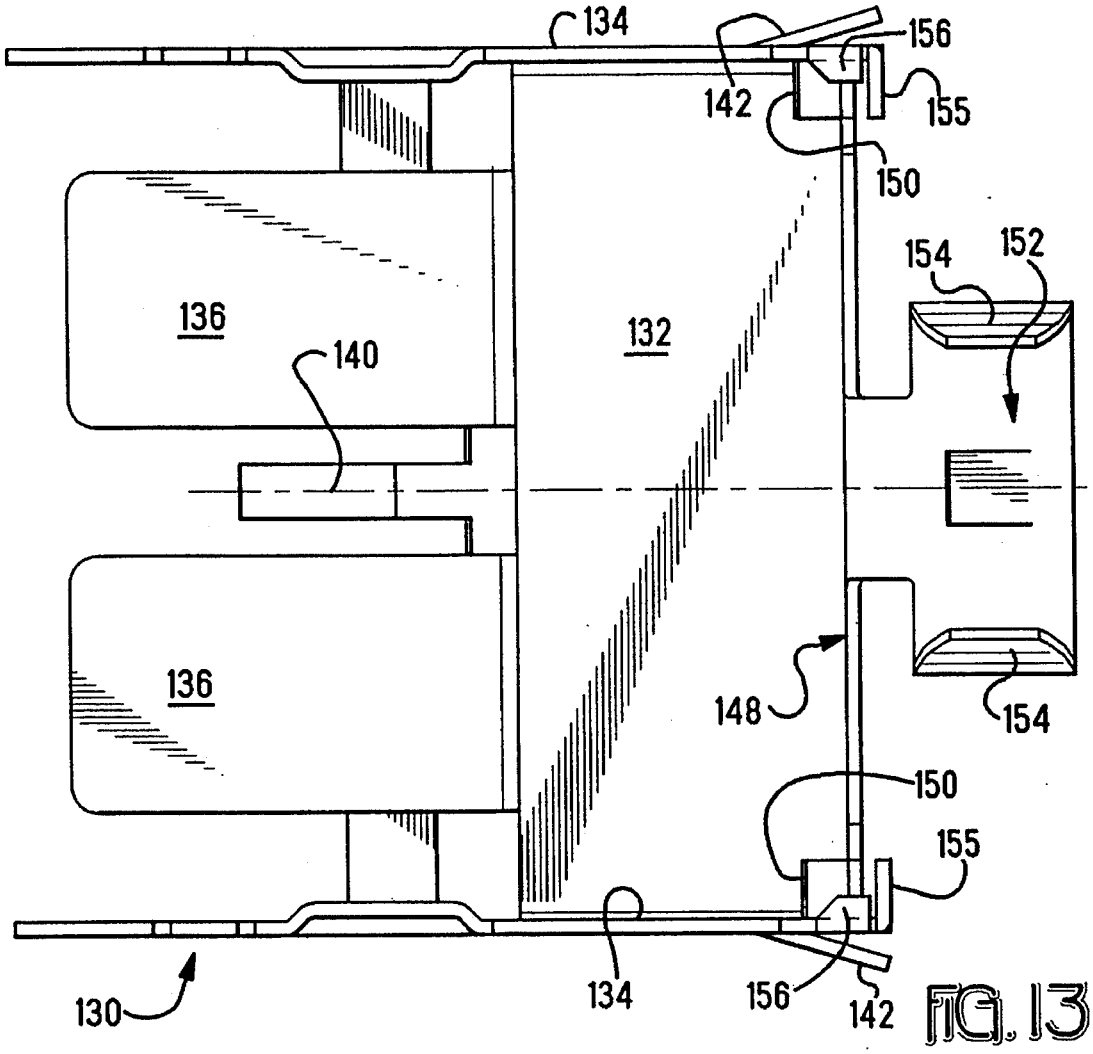
FIG. 13 is an upper plan view of the lower shield member.
Figure 14:
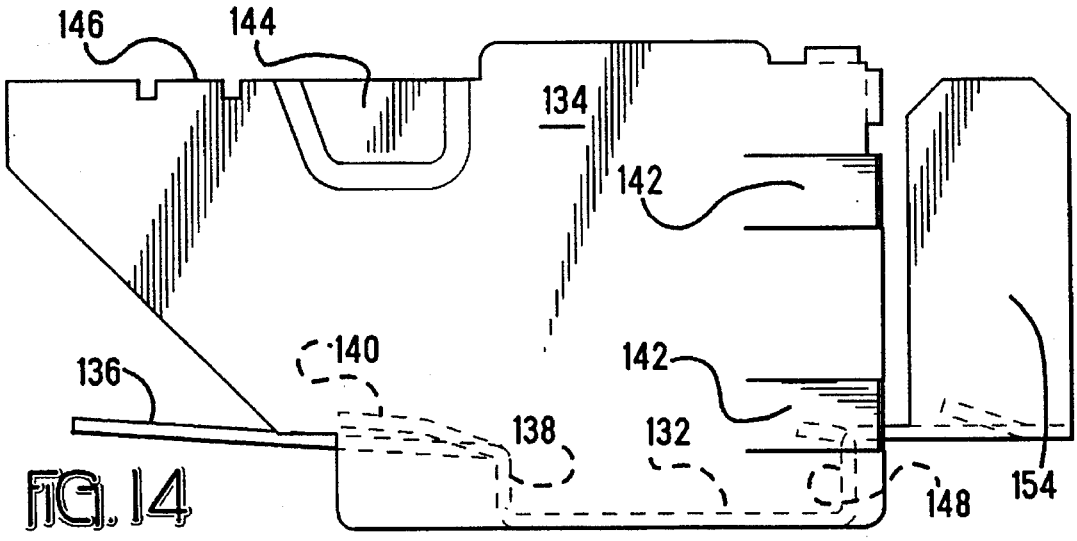
FIG. 14 is a side plan view of the lower shield member shown in FIG. 13.

With respect now to FIGS. 13 and 14, the lower shield member 130 includes a lower plate portion 132 having upwardly extending side wall portions 134. The lower plate portion 132 has shield tongues 136 extending forwardly from a front wall portion 138. As shown best in FIG. 13, a grounding contact member 140 also extends forwardly from the wall portion 138 and is medially positioned between the contact tongues 136. Side wall portions 134 include latch elements 142 stamped out of wall portions 134 and tabs 146. A rear plate 148 extends upwardly from the plate portion 132 and includes tab members 150 on opposite sides thereof, as well as an integral clamp member 152 having crimp arms 154 for crimping to the braid of a shielded cable as will be described in greater detail herein. It should be appreciated that a generally cylindrical crimping ferrule is to be inserted over the crimp arms 154, to ensure a good ground connection.

Figure 16:
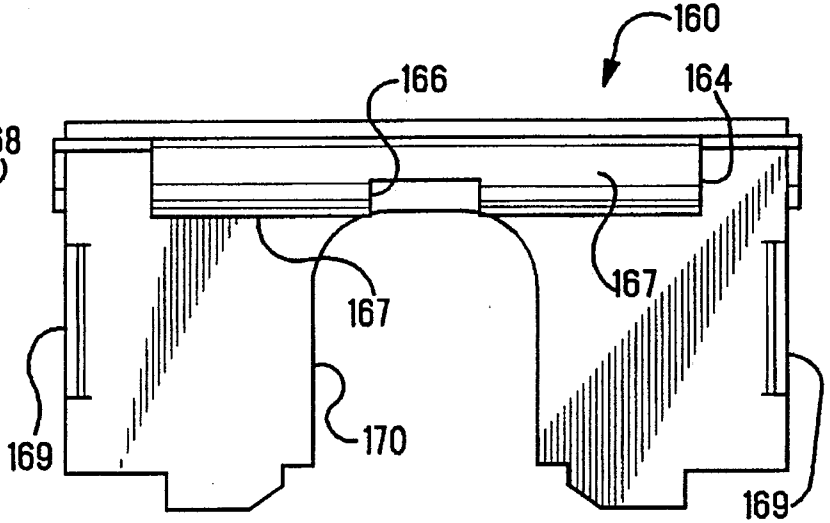
FIG. 16 is a front plan view of the upper shield member shown in FIG. 15.
Figure 15:
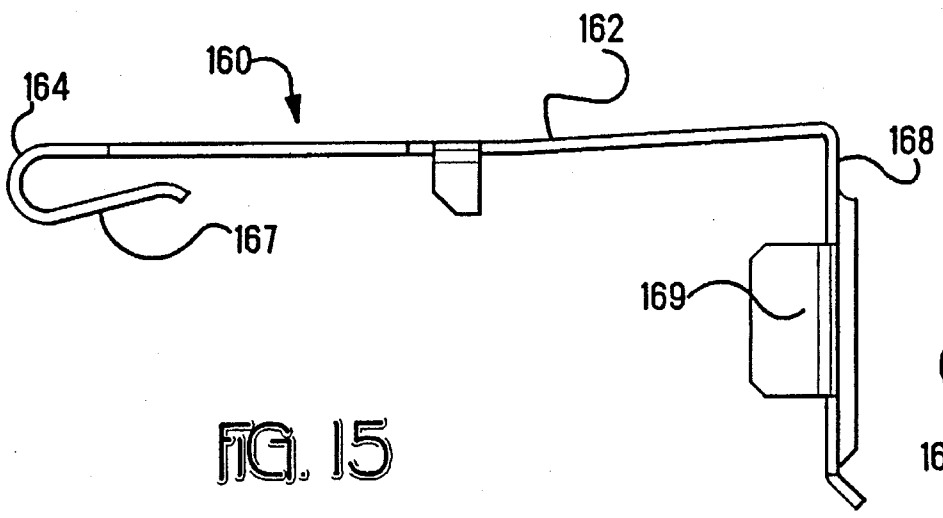
FIG. 15 is a side plan view of the upper shield member.

With reference now to FIGS. 15 and 16, the upper shield member 160 includes an upper plate portion 162 having a forward hook section 164 where the hook section has a slot 166. The plate portion 162 includes a rear plate portion 168 extending rearwardly therefrom having a cable opening 170.

Figure 17:
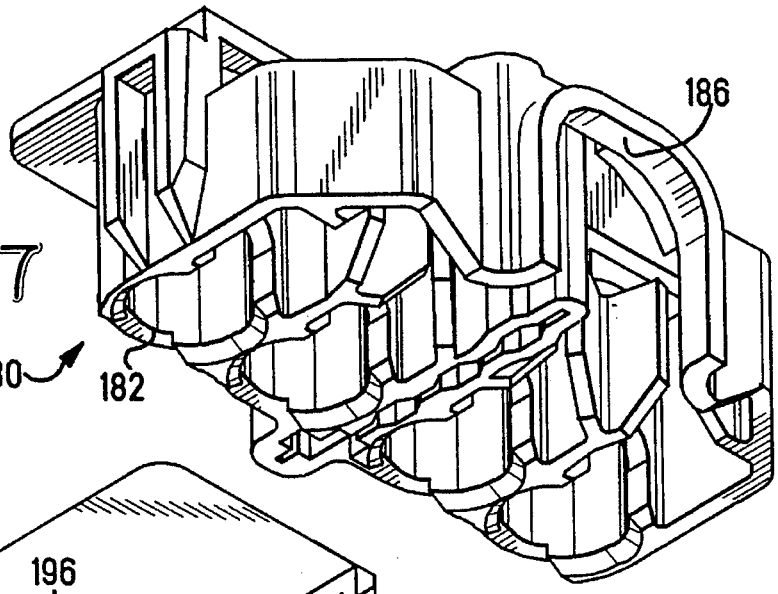
FIGS. 17 and 18 are isometric views of the stuffer cap of the present invention.
Figure 18:
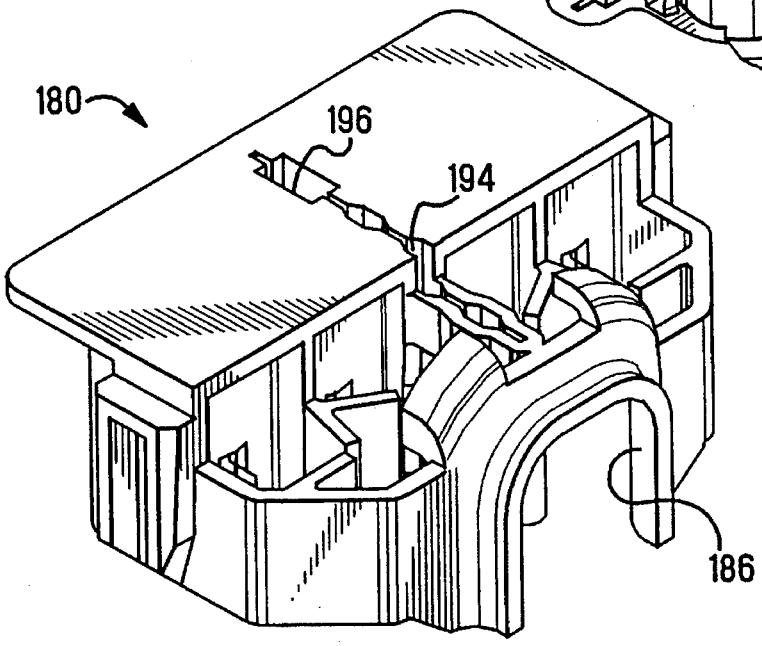
Figure 19:
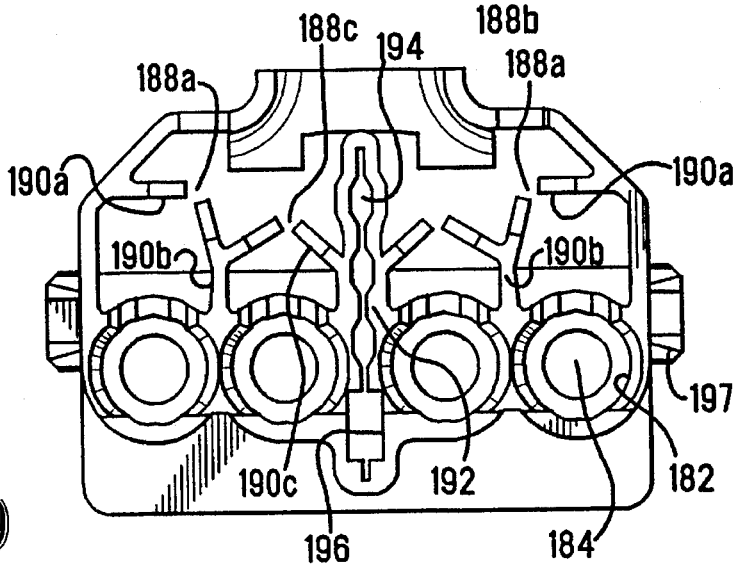
FIG. 19 is a lower plan view of the stuffer cap shown in FIGS. 17 and 18.

With reference now to FIGS. 17–19, a stuffer cap member 180 includes on the lower side thereof a plurality of terminal receiving portions 182 profiled to be slidably received over the barrel terminal 34 (FIG. 1) and further includes posts 184 for moving the insulated wires into a terminated condition with the slots 35. The stuffer cap also includes a wine opening at 186 communicating with passageways 188*a–d* formed by integral plate members 190*a* through 190*c*. A center support wall 192 includes a slot 194 extending through the lower portion of the stuffer cap 180, as well as through the upper portion as shown in FIG. 18. As shown in FIG. 18, the slot 194 includes an enlarged opening 196, which will be described in greater detail herein.

Figure 21:
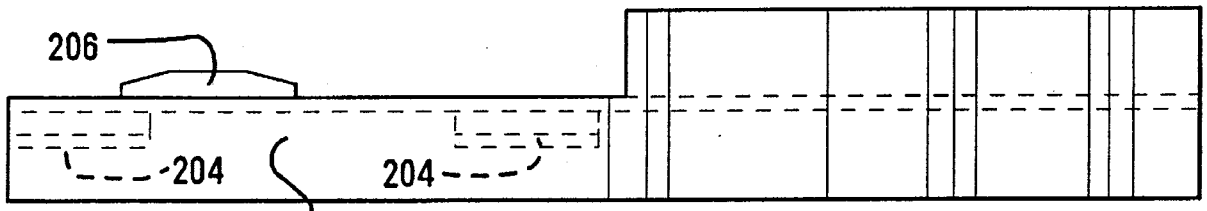
FIG. 21 is an upper plan view of the cross talk shield shown in FIG. 20.
Figure 20:
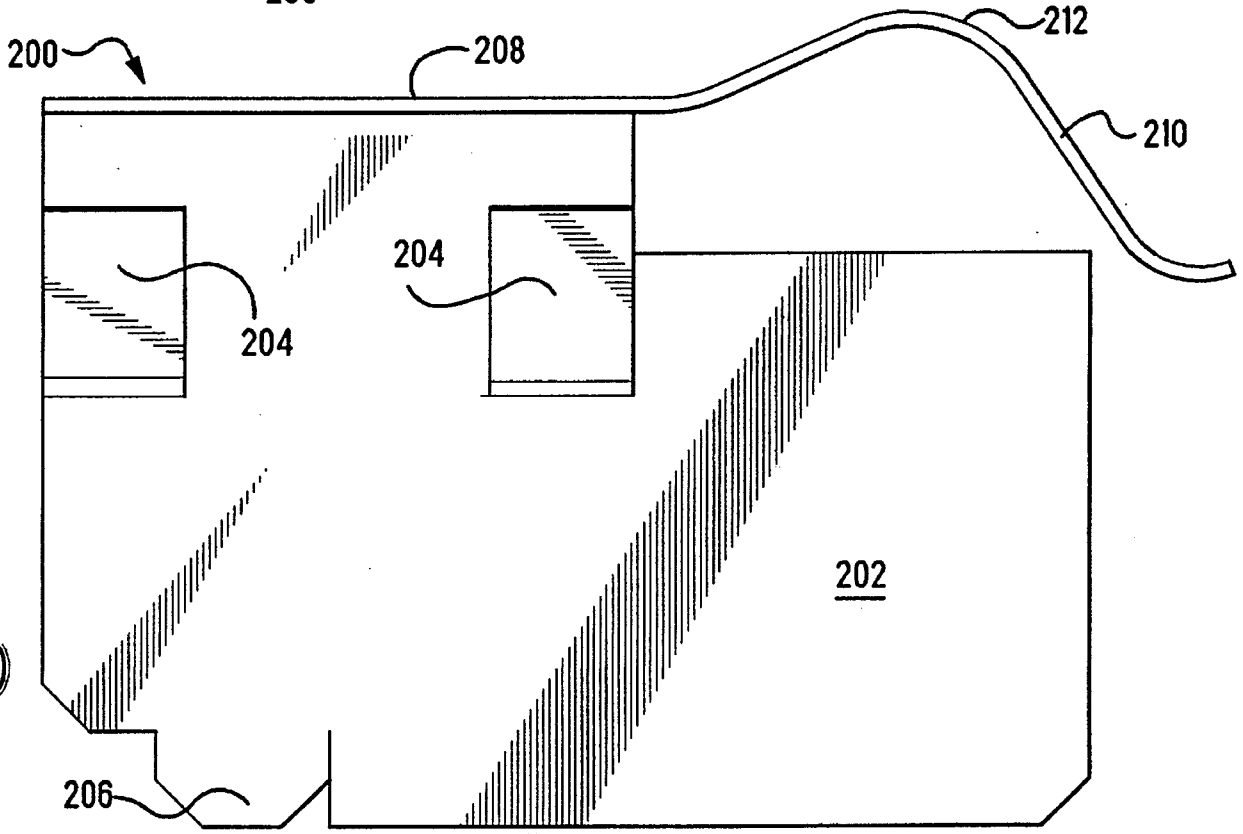
FIG. 20 is a side plan view of the cross talk shield used in conjunction with the stuffer cap shown in FIGS. 17–19.
Figure 22:
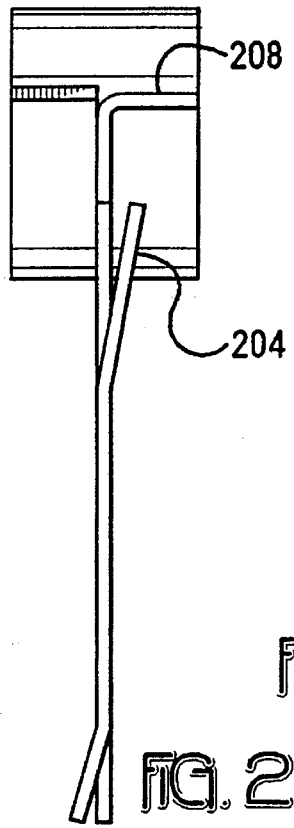
FIG. 22 is an end view of the cross talk shield shown in FIG. 20.

With reference now to FIGS. 20–22, a cross talk shield member 200 includes a plate portion 202 having side tabs 204 extending outwardly from one side thereof and a lower tab member 206 extending from the other side thereof, as shown best in FIG. 22. A resilient contact member is formed by a folded over plate section 208 where the section 208 includes a resilient cantilever spring 210 extending outwardly thereof including a contact section 212. This shield member 200 is profiled to be received in the slot 194 of the stuffer cap 180, with the resilient contact member 210 extending over the cable opening 186.

Figure 24:
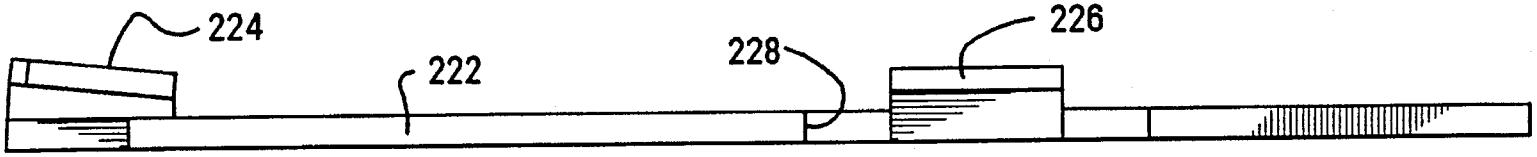
FIG. 24 is an upper plan view of the cross talk member shown in FIG. 23.
Figure 23:
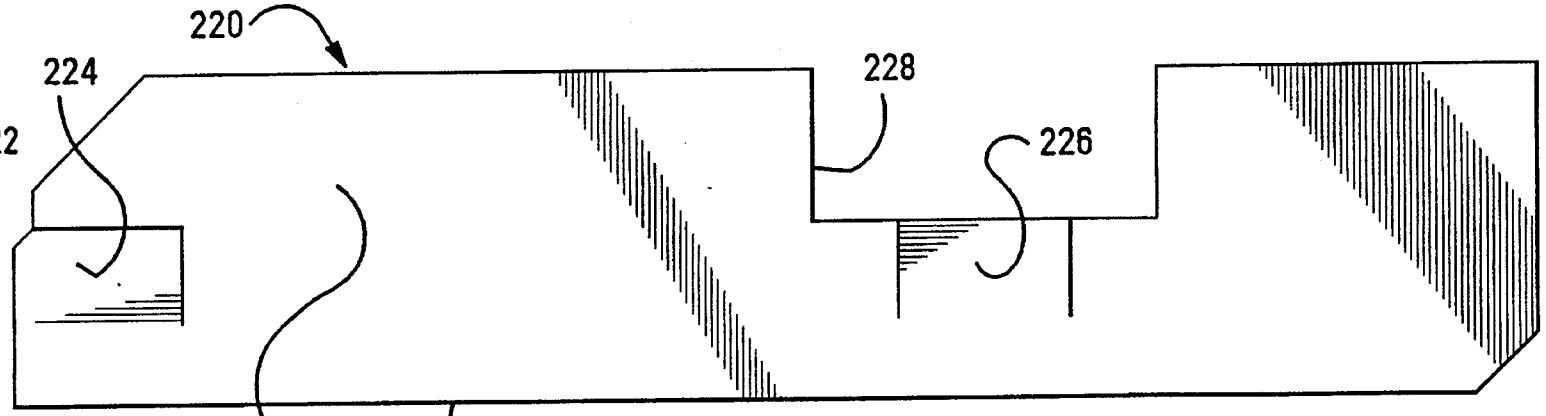
FIG. 23 is a side plan view of the cross talk shield member found in the body member shown in FIGS. 1–4.
Figure 25:
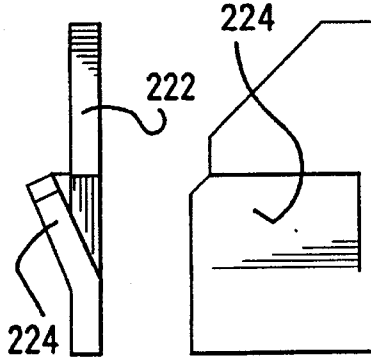
FIG. 25 is a front end view of the cross talk shield shown in FIG. 23.

With respect now to FIGS. 23–25, a further cross talk shield 220 is shown generally as an elongate plate 222 having a locking tab 224 at the front end thereof and a locking tab 226 intermediate its length. A notched portion 228 is located over the tab portion 226. This shield member 220 is profiled to be received in the slot 50 of housing 4.

Figure 29:
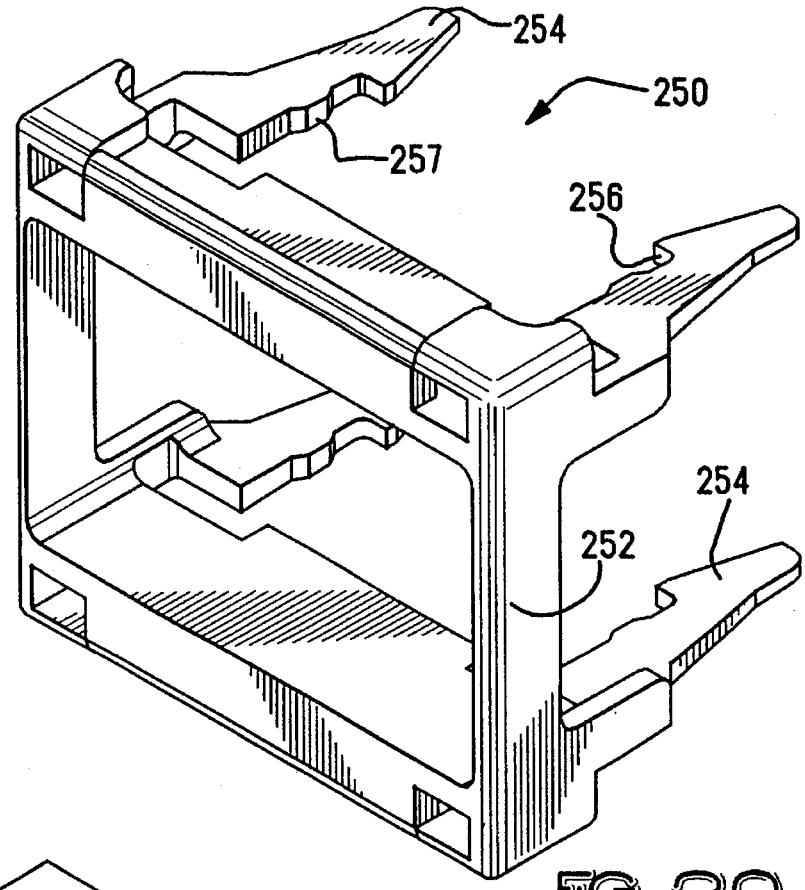
FIG. 29 and 30 are isometric views of a locking member.
Figure 30:
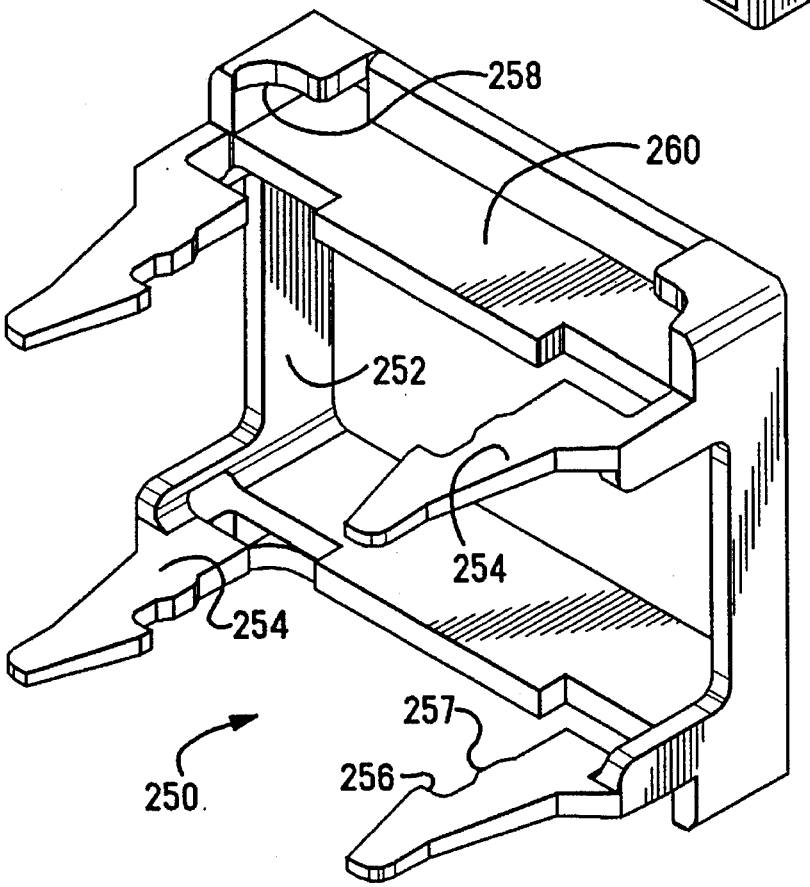

With respect now to FIGS. 29 and 30, a lock member 250 comprises a frame member 252 having legs 254 extending integrally therefrom. The legs have locking shoulders 256 adjacent to ends thereof, and medially positioned detent members 257. A corner lock 258 together with a plate 260 provide a locking portion, as will be described herein.

With the above elements as described above, the connector is assembled as follows. The terminals 30 are slidably received in their respective slots 58 of housing 4, and moved forwardly until the locking lances are securely locked in place behind locking shoulders. The cross talk shield member 220 is then slidably receivable in the respective slot 50 to its fully rearward position as shown in FIG. 26. With the terminals 30 and the cross talk shield 220 in the loaded position, the shorting bars 47 can now be positioned in the appropriate slots 44 and extend downwardly into the lower slot portions 45, as shown in FIGS. 1 and 26. It should be appreciated that the slot 228 in the cross talk shield 220 allows the transverse passage of the shorting bars 47 therethrough.

A shielded cable can now be prepared by stripping back the insulation, and separating the individual twisted conductors and placing the twisted pairs in respective openings 188*a–*188*c* of stuffer cap 180 with the free end of each wire extending into the associated tubular portion 182. The stuffer cap including the shielding plate member 200 can now be placed in the housing member 4 with the side lugs 197 cooperating with channels 23 in the housing side walls 18. This brings the conductor inside the insulated wire into electrical connection with the slot 35 in the barrel 34. The downward movement of the stuffer cap 180 also brings the shield member 200 into the position shown in FIG. 26. The shield member 200 and the shield member 220 are laterally staggered, to prevent end to end abutment. However, to prevent the two shield members from edge stubbing, the cross talk shield 200 has a side foot 206 positioned at the leading edge, which, in the event of possible stubbing, will move the plate 202 sideways behind the shield 220, to the position shown in FIG. 26.

The upper and lower shield members 160,130 can now be placed over the housing 4, with the lower portion being placed first over the housing 4 with the plate portion 132 residing against the lower portion 46 and with the contact tongues 136 placed adjacent to the lower surface 48. This positions contact member 140 of the lower shield member 130 in the window 60 in the-lower housing portion and into resilient contact with a lower edge 223 of the cross talk shield member 220 as shown in FIG. 26. The upper shield member 160 can now be placed over the housing 4 with the front hook portion 164 engaging the front hood member 24 and with the individual contact tongue portions 167 (FIG. 16) extending intermediate the center rib 28. The upper shield member 160 is in its fully locked position when the rear plate portion 168 is positioned behind the tab members 155 of the lower shield member 130 (FIG. 13), and the upper plate portion 162 is positioned below the tab members 156. When in the full locked position, the side plate portions 169 fit inside the sidewalls 134, into the recesses 19 of housing 4 to cover the shield windows created by the latches. It should be appreciated that the resilient contact member 210 extends above the top surface of the stuffer cap, thus downward movement of the upper shield member 160 into its fully locked position, brings the upper plate portion 162 into ground contact with the contact member 212 on the cross talk shield 200. It should be appreciated from FIG. 26 that the contact portions 36 of contacts 30 are substantially shielded against cross talk along their length, and their terminal barrel portions 35 as well as the signal pairs are prevented from cross talk by the cross talk shield member 200.

The assembly can be completed by crimping the arms 154 on the lower shield member to bring the shield arms into a crimp condition with the shielding braid of the shielded cable, which also commons the cross talk shield members 220 and 200 to the shielding braid. The shielded sub-assembly as described above is then insertable into the housing member 70 (FIGS. 5 and 6) through the rear side thereof until the housing 4 abuts the forward lip 85, whereupon the latches 142 are snapped in place within respective apertures 84. The strain relief member 110 (FIGS. 27, 28) is then assembled over the shielded cable and together with assembled support members 95 (FIGS. 7–9) are moved into a fully locked position where latch 106 engages in the window 83 of the housing member 70 to provide a strain relief to the cable as well as retain the shielded sub-assembly inside the housing 4.

Figure 27:
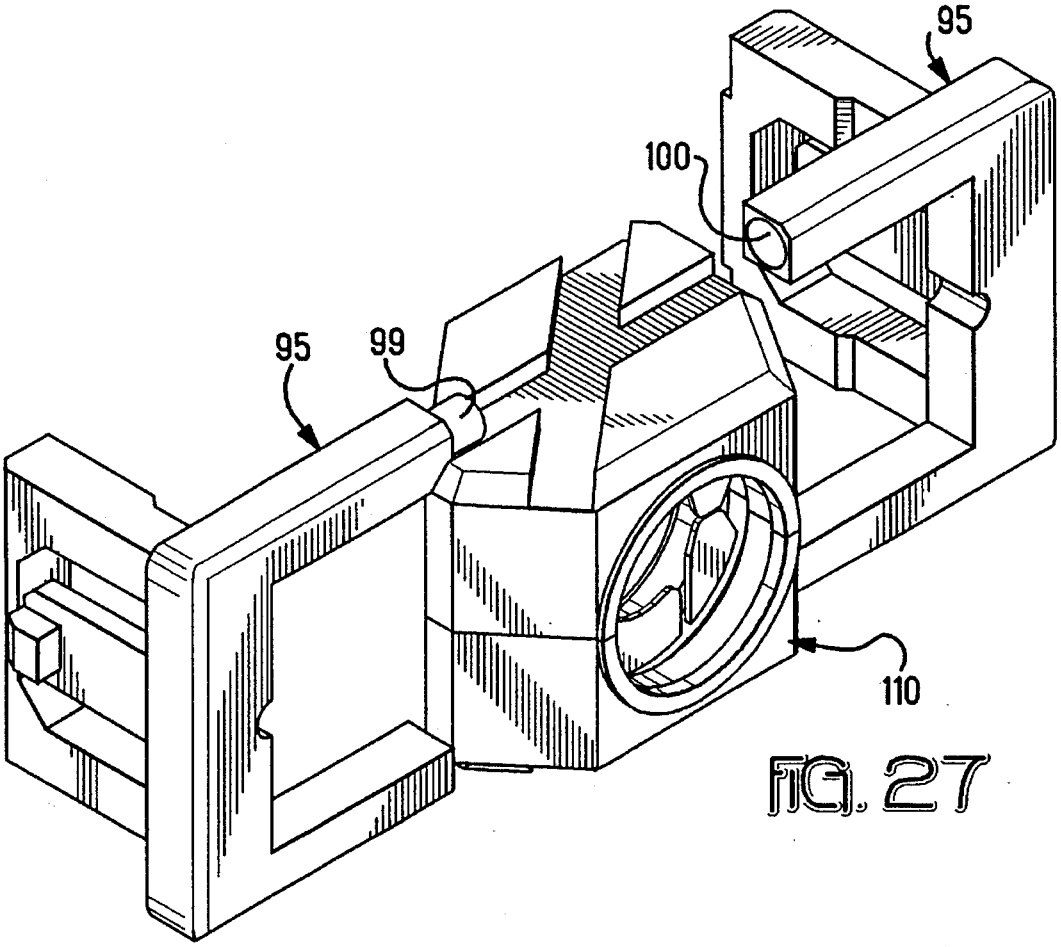
FIG. 27 is an assembly view of the back-plate and strain relief members.
Figure 28:
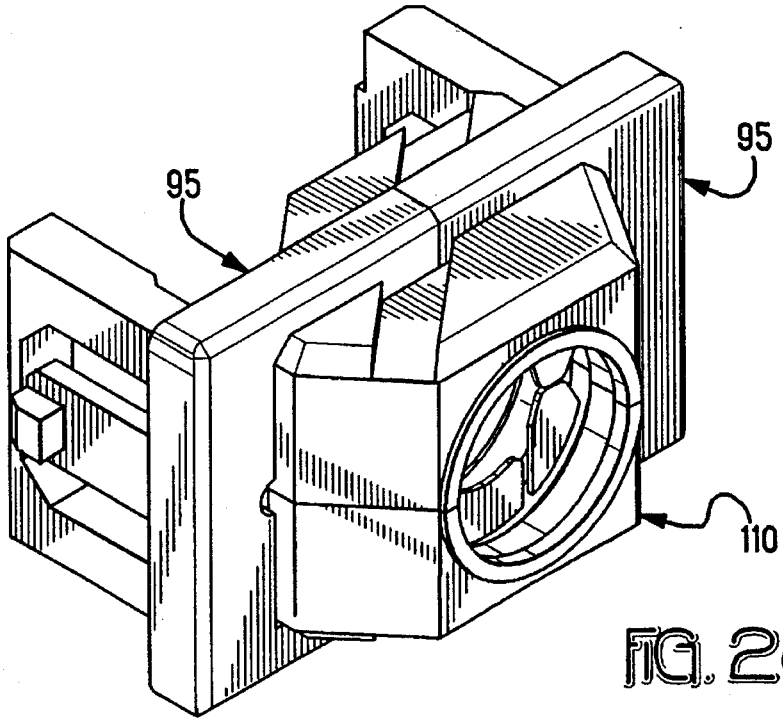
FIG. 28 is a view similar to that shown in FIG. 27, but in the assembled condition.
Figure 31:
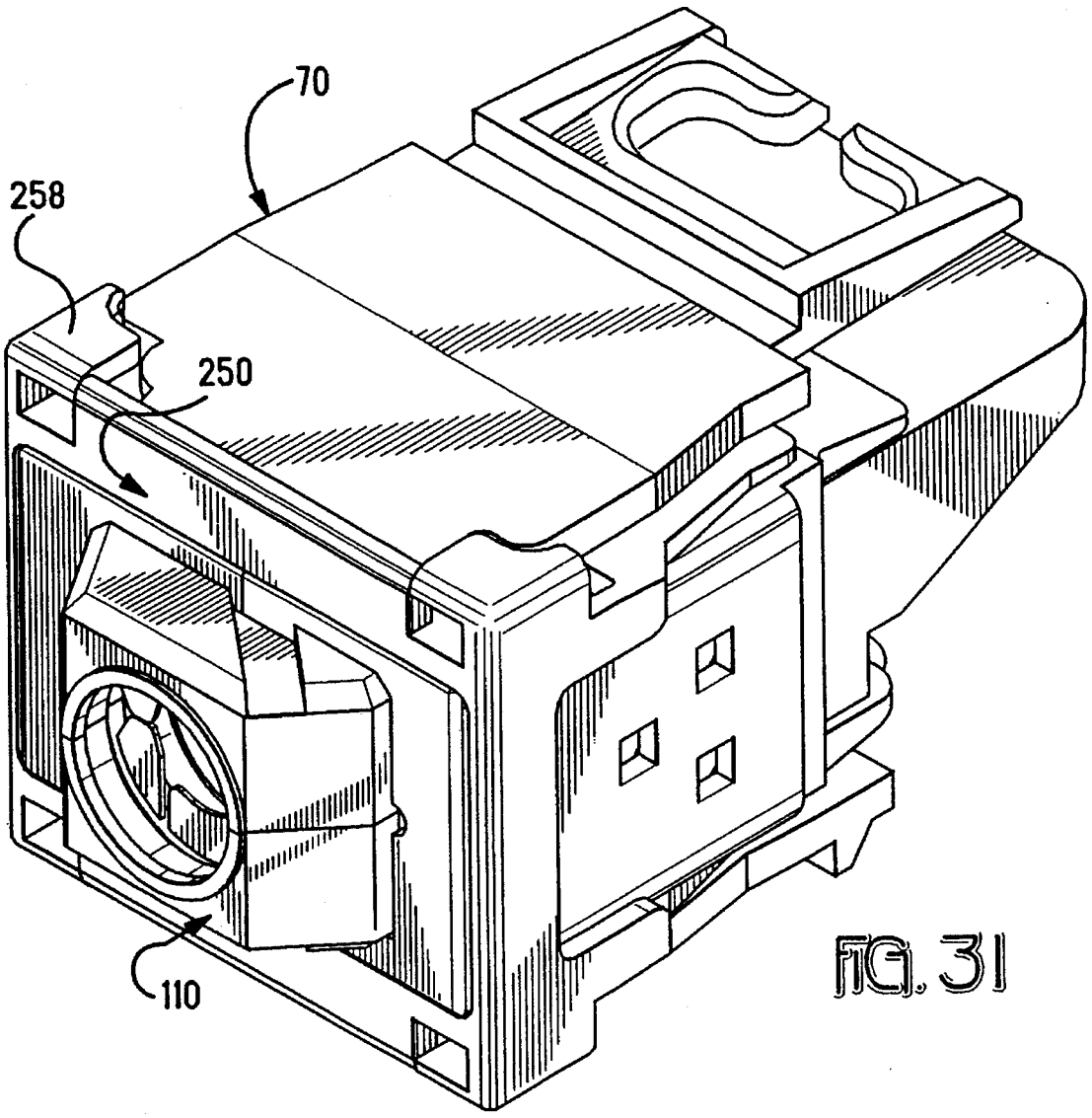
FIG. 31 is a rear isometric view of the fully assembled connector.

The cooperation of the strain relief member 110 with the rear plate members 95, is shown in FIGS. 27 and 28. The locking member 250 (FIGS. 29 and 30) can now be assembled into the position shown in FIG. 31, where the corner locks 258 overlap the rear edges 75 (FIG. 5) to prevent movement of the latching plates 74,76. The legs 254 are slidably received between the latching plates 74 and 76, and when in the locked position, the latch shoulders are snapped against the webs 73 (FIG. 5). In this position the latch plates cannot be moved either upwardly or downwardly.

Figure 32:
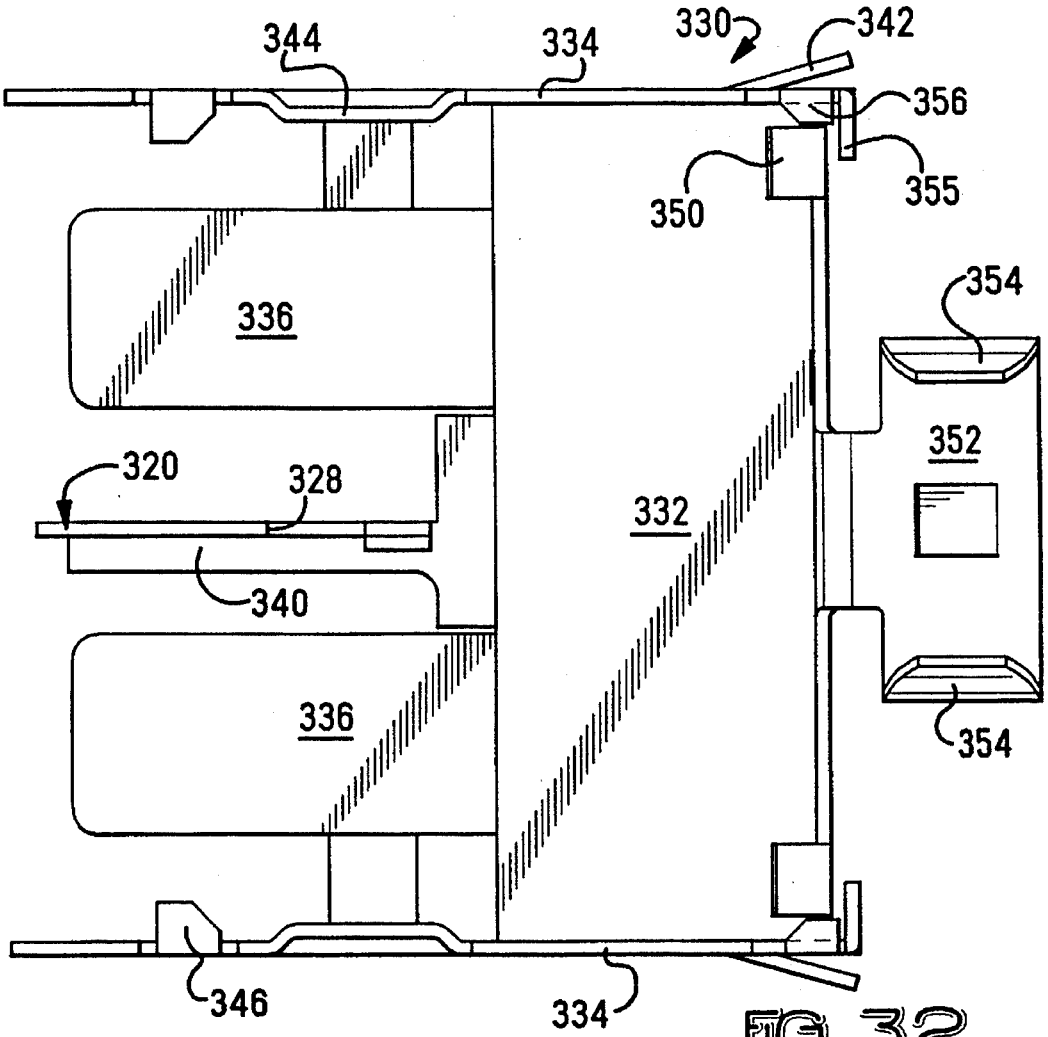
FIG. 32 is an upper plan view of an alternate lower shield portion.
Figure 33:
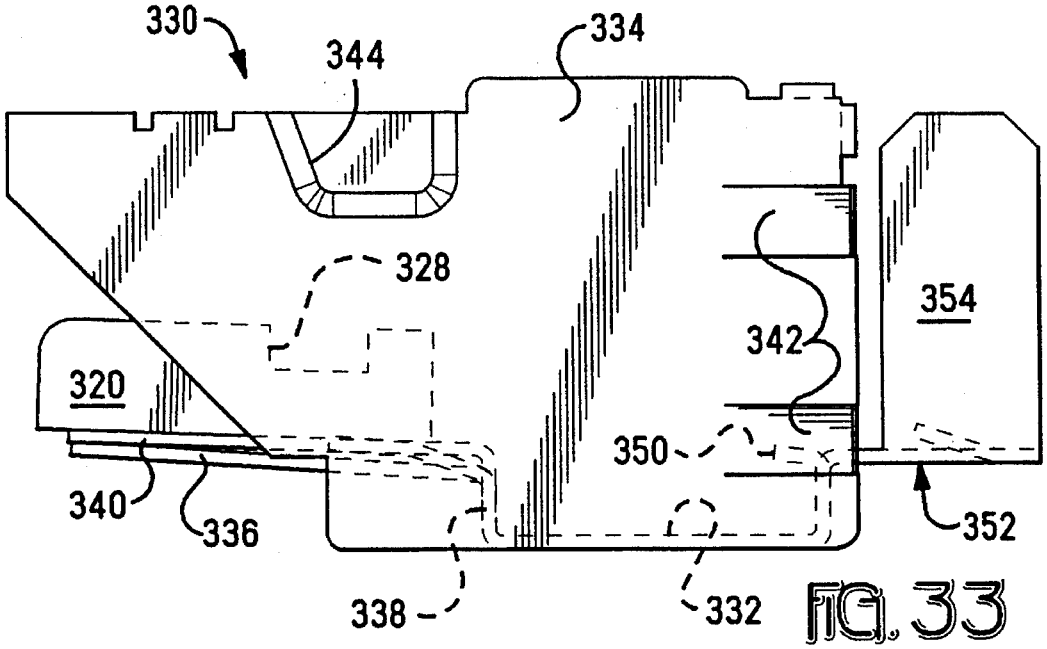
FIG. 33 is a side plan view of the alternate shield shown in FIG. 32.
Figure 34:
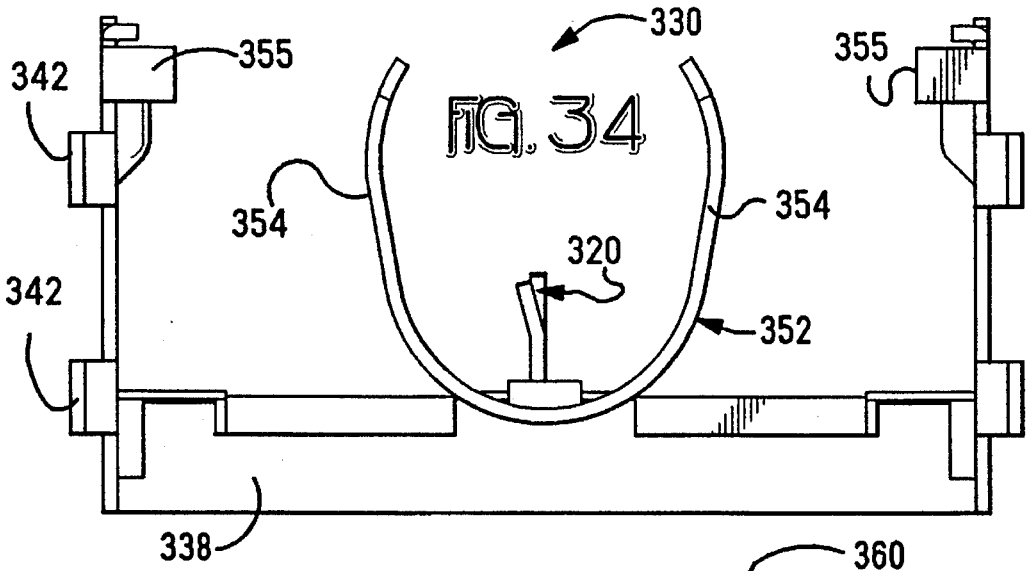
FIG. 34 is an end view of the alternate shield shown in FIGS. 32 and 33.

With respect now to FIGS. 32–34, an alternate lower shielding member 330 is shown having a base plate portion 332 having upwardly extending sidewalls 334 formed at a right angle thereto with shielding tongues 336 extending forwardly from the plate portion 332 by way of an intermediate wall 338. A central tongue 340 extending intermediate tongue portions 336 has a bent up plate portion 320 which forms the analogous shield member as member 220 in FIG. 23. The shield member 320 also includes a notch 328 for the transverse positioning of the shunting bars 46 as shown earlier in FIG. 26. The shield member 330 further includes tabs 342, 344, 346, 350, 356, and 355 which function as previously described. The lower shield member 330 also includes an integral clamp member 352 having two upstanding crimpable arms 354 as best shown in FIGS. 33 and 34.

Figure 35:
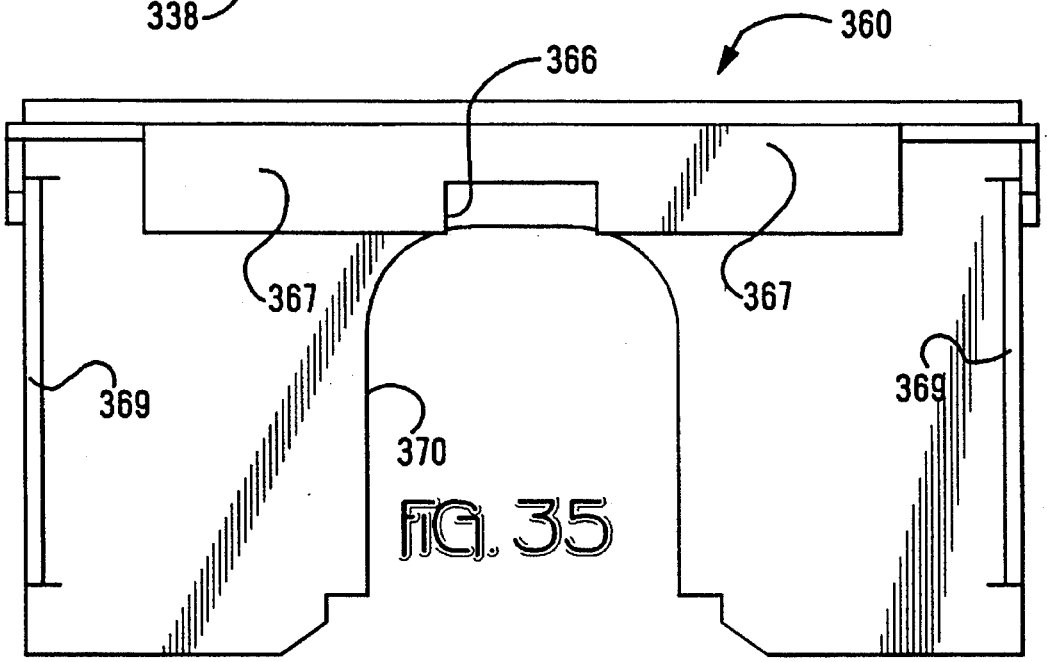
FIG. 35 is an alternate shield usable with the lower shield member shown in FIGS. 32–34.
Figure 36:
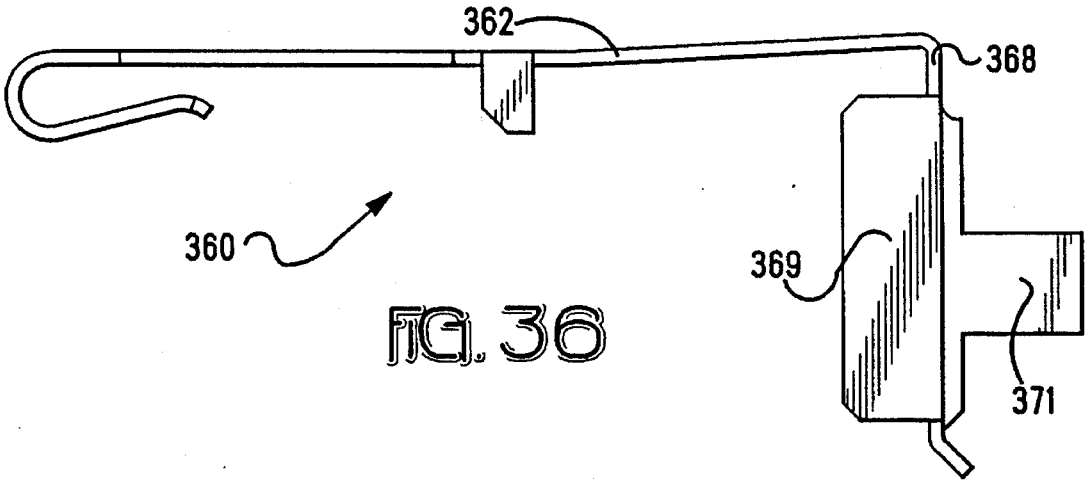
FIG. 36 is a side plan view of the upper shield member shown in FIG. 35.
Figure 37:
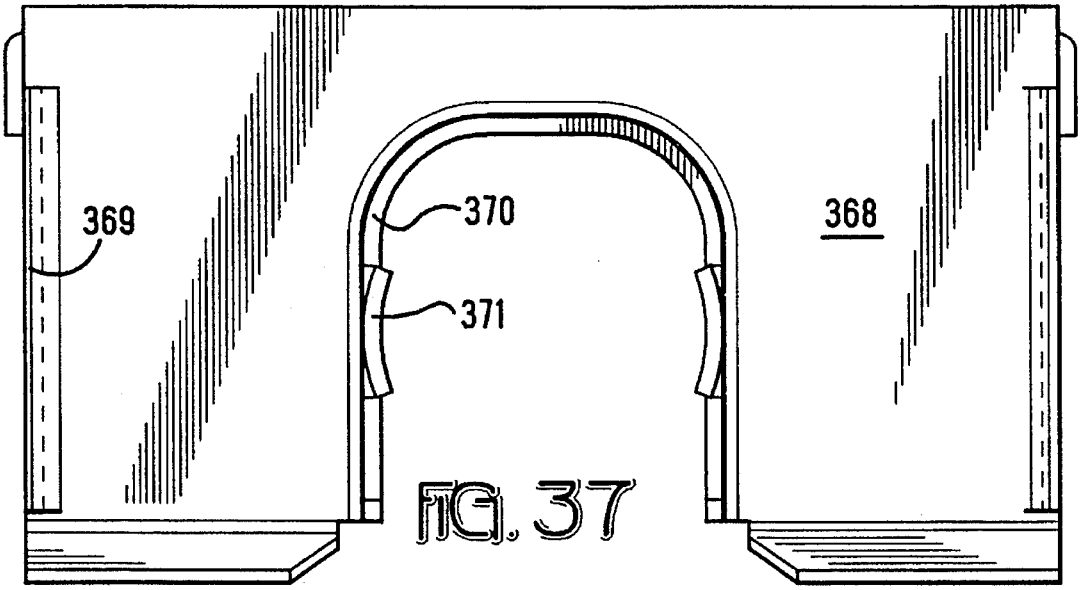
FIG. 37 is an end view of the shield member shown in FIG. 36.

With respect now to FIGS. 35–37, the upper shield member 360 includes an upper plate portion 362 having a forward hook section 364. A notch 366 spans the front post portion 28 of housing 4 as previously described. The contact portions 367 are thereby positioned against the surface 26 (FIG. 2) as previously described with respect to shield member 160. The shield member 360 further includes a rear plate portion 368 having an opening 370 for receiving the shielded cable, and integral shielding arms 371 extending rearwardly from the opening 370. The arms 371 are profiled to be received in a downward movement between the two arms 354 to reside adjacent to the shielded cable to be terminated. The arms 354 are crimped around the arms 371 by use of a locking ring 400 thereby assuring intimate contact between the arms 354, 371 and the shielded cable to be terminated.

Figure 38:
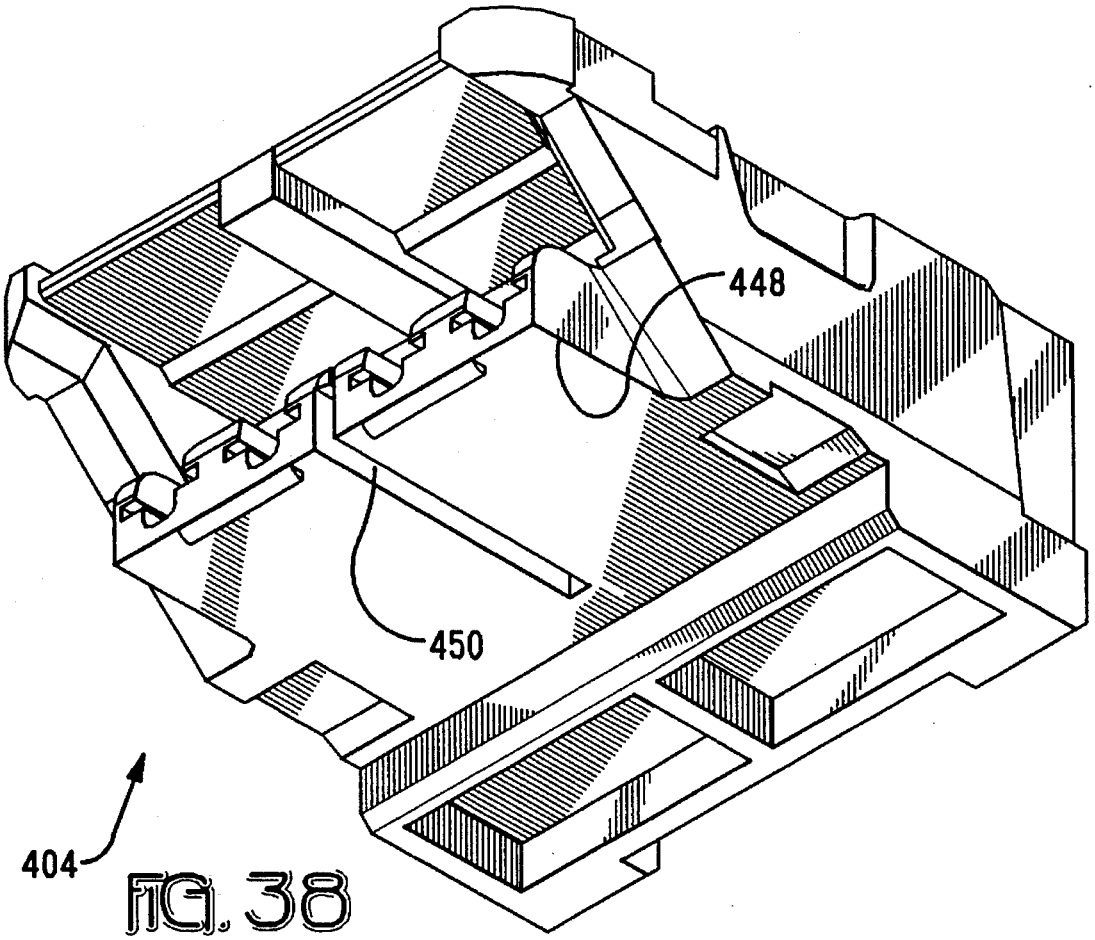
FIG. 38 is a lower isometric view of the inner housing for use with the shield members of FIGS. 32–37.

The shield members 330, 360 are assembled to the inner housing 404 (FIG. 38) in an identical manner as that previously described, except that the shield 330 has an integral shield plate 320, and therefore is placed in a slot 450 of a bottom member 448 of the inner housing 404. This places the integral shield member 320 in the same position as that shown in FIG. 26.

As shown in FIGS. 39–43, an alternate top shield member 460 can be provided having a top plate portion 462 having a front hook section 464 and a rear plate portion 468. The rear plate 468 includes side flaps at 469 extending forwardly therefrom, and an integral shroud 470 surrounding an opening for the shielded cable. Integral ground contacts arms 471 extend from the rear plate portion 468 for crimped engagement with the shielding braid of a shielded cable, as described above.

Figure 39:
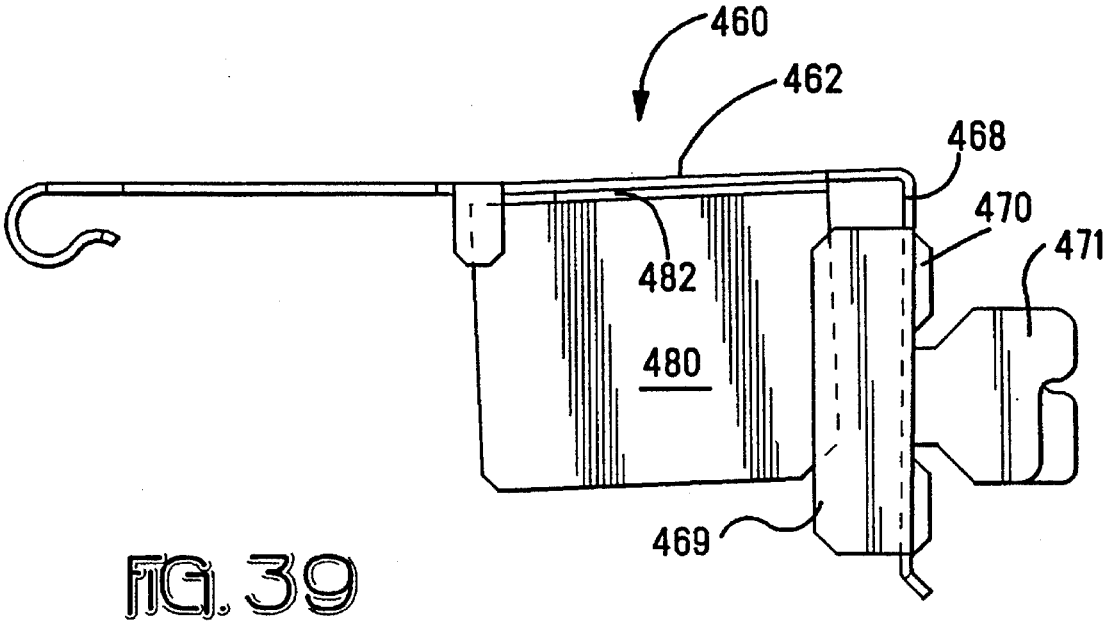
FIG. 39 is a side plan view of an alternative embodiment of the top shield member.
Figure 40:
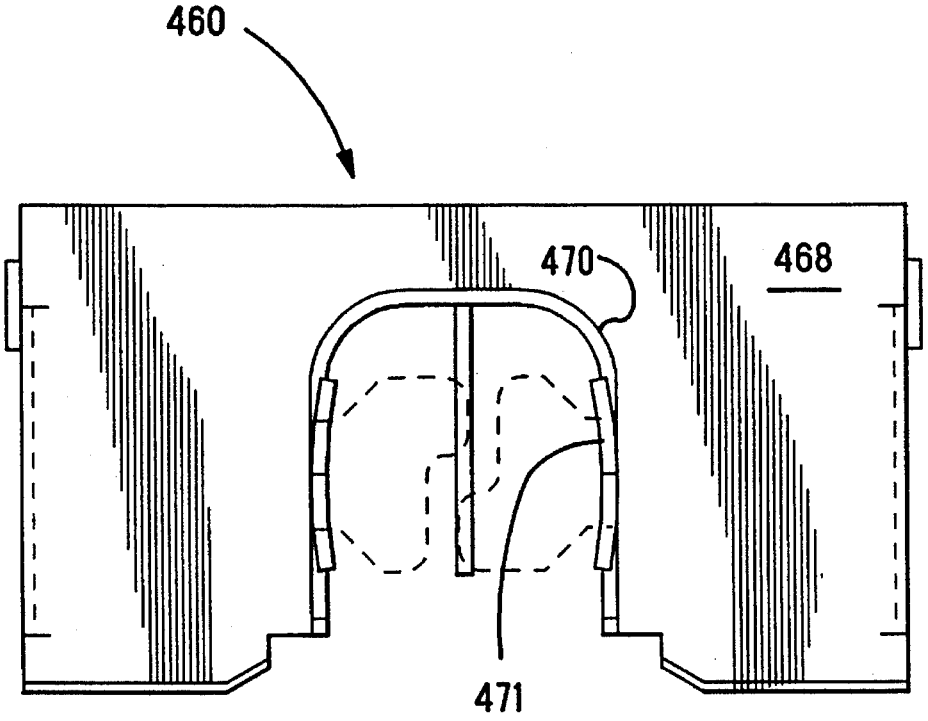
FIG. 40 is an end plan view of the alternative embodiment of the top shield member of FIG. 39.
Figure 41:
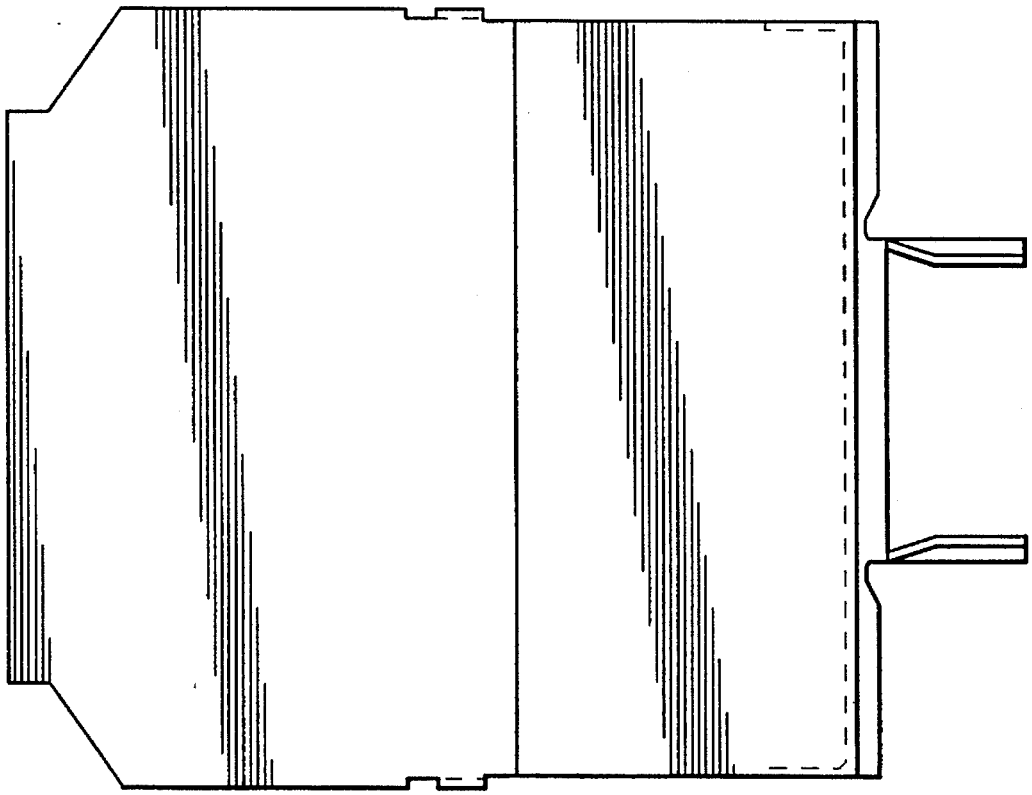
FIG. 41 is an upper plan view of the alternative embodiment of the top shield member of FIG. 39.
Figure 42:
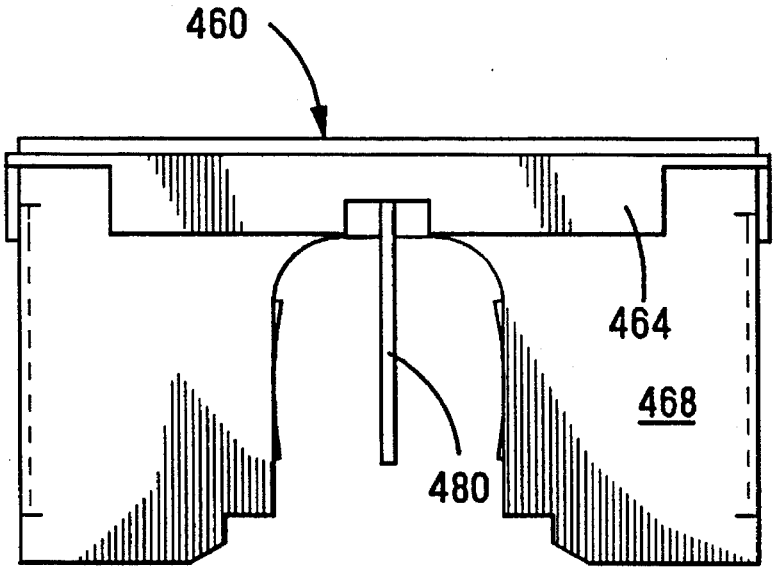
FIG. 42 is another end plan view of the alternative embodiment of the top shield member of FIG. 39.
Figure 43:
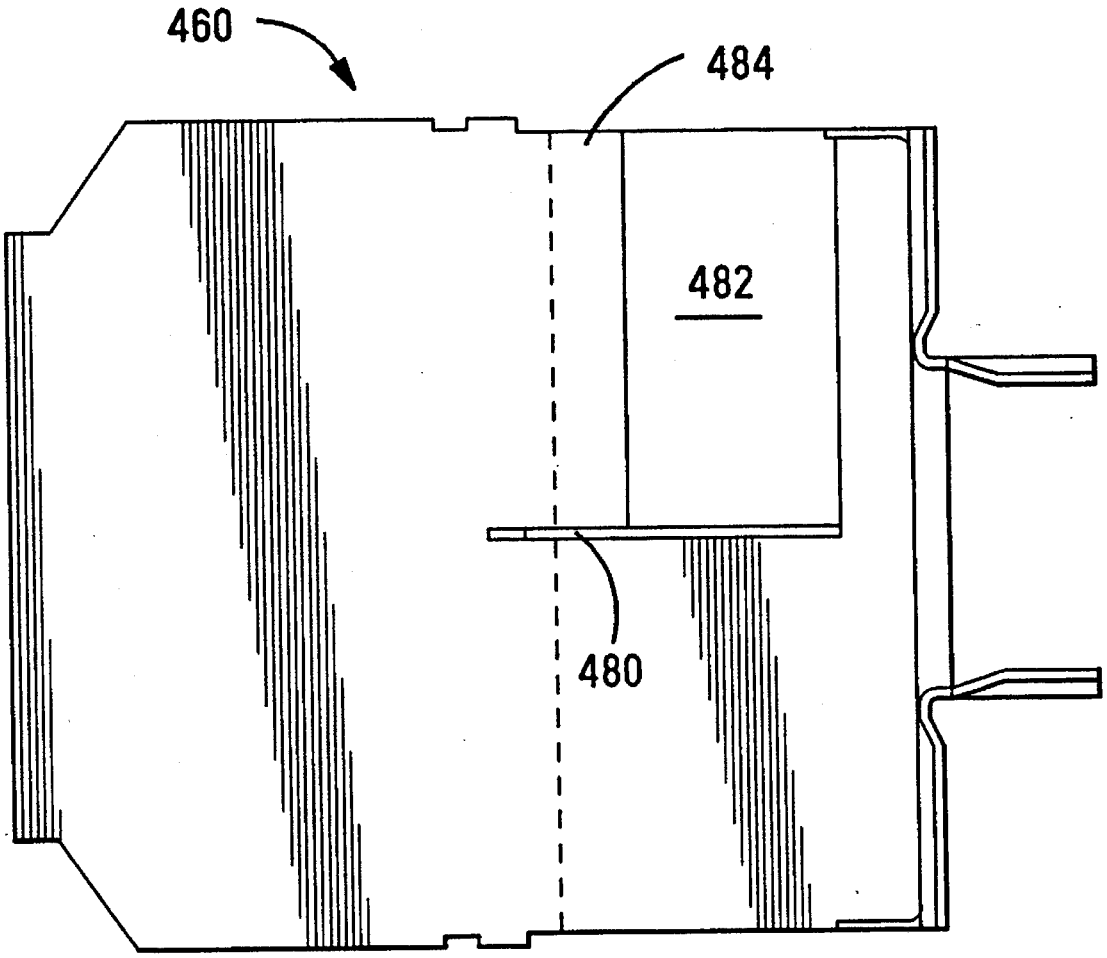
FIG. 43 is a lower plan view of the alternative embodiment of the top shield member of FIG. 39.

In this embodiment of the top shield member 460, an integral cross-talk shield 480 is provided by a strap portion 482 extending integrally from a side edge 484 and folded flush with the top plate member 462 as shown best in the side plan view of FIG. 39 and the lower plan view of FIG. 43. The top shield member 460 shown in FIGS. 39–43 is usable with any of the lower shield member described herein, and is also usable with the stuffer cap 180 as described with reference to FIGS. 17–19, the integral cross-talk shield 480 being receivable within the slot 194 of the stuffer cap 180.

Figure 44:
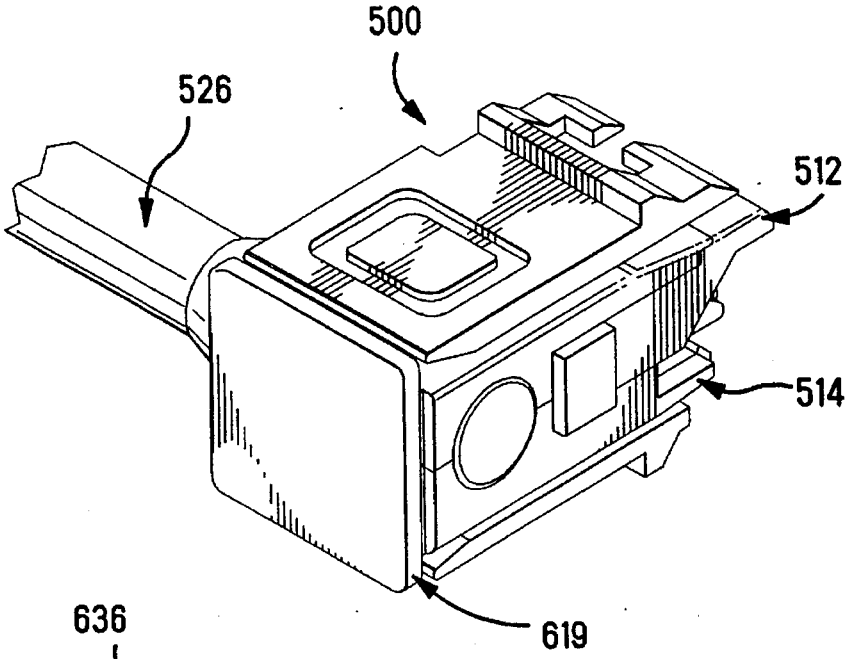
FIG. 44 depicts an exemplary electrical connector in accordance with the present invention, illustrated from an oblique view.

Referring now to FIG. 44, therein is shown an exemplary electrical connector 500, in accordance with the present invention. Electrical connector 500 is a data connector having many component portions generally as described in U.S. Pat, No. 4,449,778, and in U.S. Pat. No. Re. 32,760. The specification of U.S. Pat. Nos. 4,449,778 and Re. 32,760 are hereby incorporated herein by reference for all purposes. Electrical connector 500 is of hermaphroditic construction and is thereby designed to mate with an identical, relatively inverted, connector.

Figure 45:
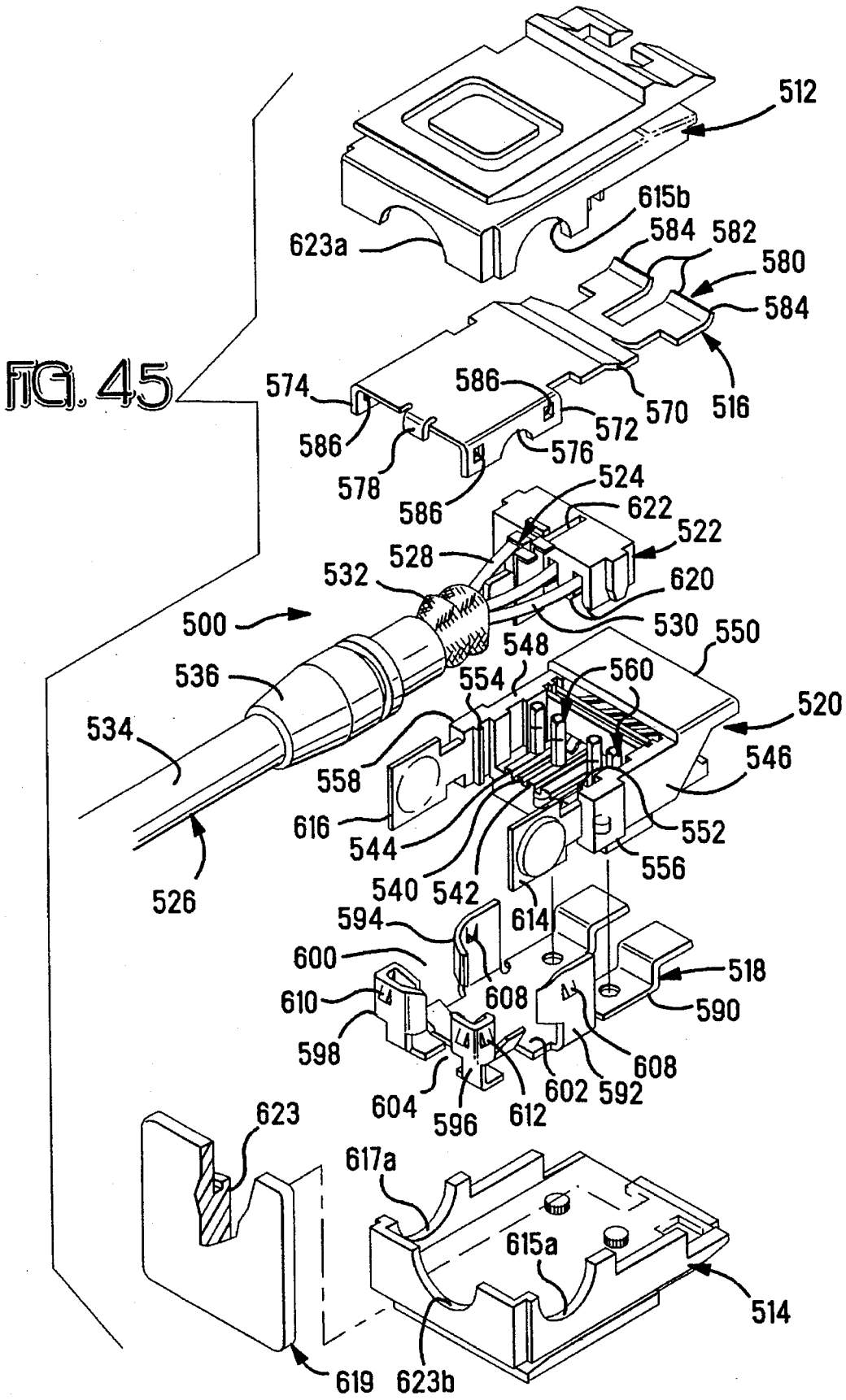
FIG. 45 depicts the connector of FIG. 44, illustrated in an exploded perspective view.

Referring now also to FIG. 45, connector 500 includes an upper cover 512 and a lower cover 514. Upper cover 512 and lower cover 514 are configured to cooperatively engage one another. When engaged, in the manner depicted in FIG. 44, upper and lower covers 512, 514 form a housing assembly. Both covers 512, 514 will preferably be formed of an insulating material, such as an insulating plastic. Connector 500 also includes an upper cable clamping ground shield 516 and a lower cable clamping ground shield 518, each of which will lie substantially within the assembled housing of connector 500. Connector 500 further includes a terminal housing 520 and a stuffer cap 522. Shown associated with stuffer cap 522 is central shield 524 and a cable 526. Cable 526 is of a type particularly suitable for use with electrical connector 500. Cable 526 includes two pairs of conductors 528, 530, the conductors of each pair being twisted together within the cable in a manner well-known to the art. The two twisted pairs 528, 530 are within a shielding braid 532, within a jacket 534 of cable 526. Cable 526 also includes a bushing 536, to facilitate clamping of the cable and shield within connector 500.

Terminal housing 520 is preferably molded of a plastics material and includes a terminal platform 540 extending between forward, mating, and rear, wire connecting, faces of the housing. Terminal platform 540 includes a plurality of parallel channels 542 which extend forwardly across terminal platform 540 and define undercut terminal supporting ribs 544. Sidewalls 546 and 548 extend upwardly from opposite sides of terminal supporting platform 540 and are joined proximate the front end of housing by a transverse hoods 550. Sidewalls 546 and 548 each include internal, generally vertical, locating ribs, 552 and 554, respectively, and further include external generally vertically extending sidewall portions 556 and 558, respectively. Extending at the rear sides of terminal housing 520 are removable aperture plug segments 614, 616. Aperture plug segments 614, 616 are adapted to occupy side recesses 615*a*, 615*b*, and 617*a* (617*b* not depicted) in upper cover 512 and lower cover 514.

Figure 48:
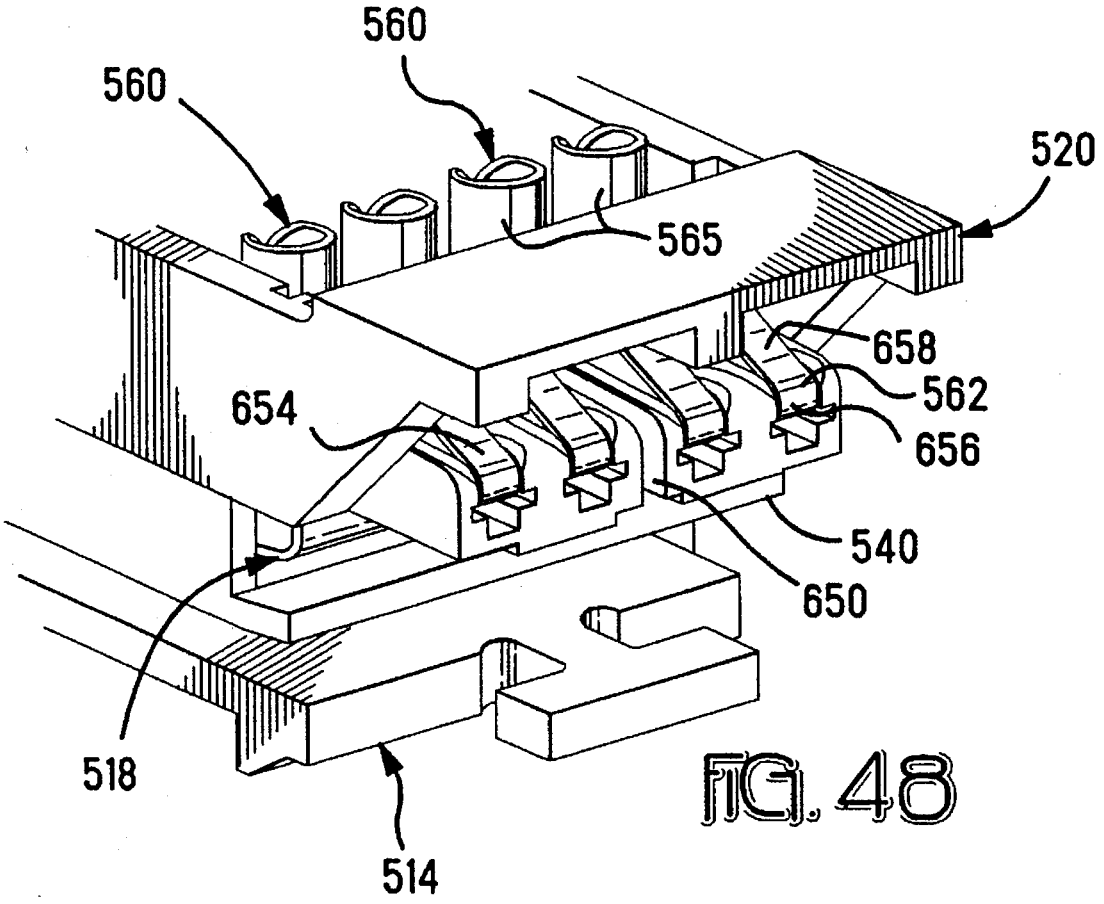
FIG. 48 depicts the connector of Figure depicts the connector of FIGS. 44–47, from a front oblique view.

A plurality of terminals, 560, are retained on terminal platform 540 of terminal housing 520. These terminals 560 will each include a body portion 654 coupled to a reversely bent contact portion 562 which will extend proximate the forward mating end of terminal platform 540 (as depicted in FIG. 48). Each terminal 560 also includes a wire receiving barrel portion 565 constructed generally in accordance with U.S. Pat. No. 3,860,318, the disclosure of which is hereby incorporated herein by reference for all purposes.

Upper and lower shields 516 and 518, respectively, are each preferably formed of a single piece of sheet metal. Upper shield 516 includes a body portion 570 and downwardly extending side flanges 572 and 574. Upper shields 516 also includes a forward bifurcated contact portion, 580, having a pair of contact tabs 582 with upturned contact surfaces 584 at their forward ends. Side flanges 572 and 574 each include a semicircular cable receiving recess 576. Cable receiving recesses 576 facilitate the connection of a cable from the side of the connector, as depicted in FIG. 44. This is accomplished in a known manner, through the removal of the appropriate aperture plug segment 614, 616 to facilitate coupling of cable 526 to covers 512, 514.

As is also apparent from the drawings, connector 500 may also accommodate a cable extending axially from the connector, in the general relationship depicted in FIG. 45. Where axial cable entry is not utilized, a rear cover 619, having an approximately sized detention insert 621 will be placed in recesses 623*a*, 623*b* in upper and lower covers 512, 514. To accommodate such an axial connection, a braid contacting tab 578 extends from a rearward portion of shield body 570.

Lower shield 518 includes a body member 590 having generally upwardly extending side flanges 592 and 594, and generally upwardly extending rear flanges 596, 598. Cable receiving apertures 600 and 602 are defined on each side; between side flange 594 and rear flange 598 on one side, and between side flange 592 and rear flange 596 on the other side. Additionally, a rear cable receiving aperture 604 is defined between rear flanges 596 and 598. It will be noted that each side flange 592 and 594, and each rear flange 596 and 598 include inwardly extending flanges to facilitate mechanical and electrical contact with cable braid 532.

Lower shield flanges 592, 594, 596, and 598 each include side detent flanges 606, 608, 610, and 612, respectively, adapted to engage receiving apertures 586, in flanges 572 and 574 of upper shield 516. This mechanism assures both mechanical and electrical connection between the two shields when connector 500 is assembled.

Stuffer cap 522 is preferably molded of a generally non-conductive, stiffy flexible plastic material, and includes a plurality of internal partition walls which define wire receiving passageways which extend between gripping flanges 620. Included within stuffer cap 522 are a plurality of barrel receiving portions, having wire engaging projections of the type generally described in U.S. Pat. No. 4,186,984, the disclosure of which is incorporated herein by reference for all purposes. Stuffer cap 522 cooperates with electrical contact barrel portions 565 to form a terminal assembly which mechanically and electrically terminates the conductors.

Figure 46:
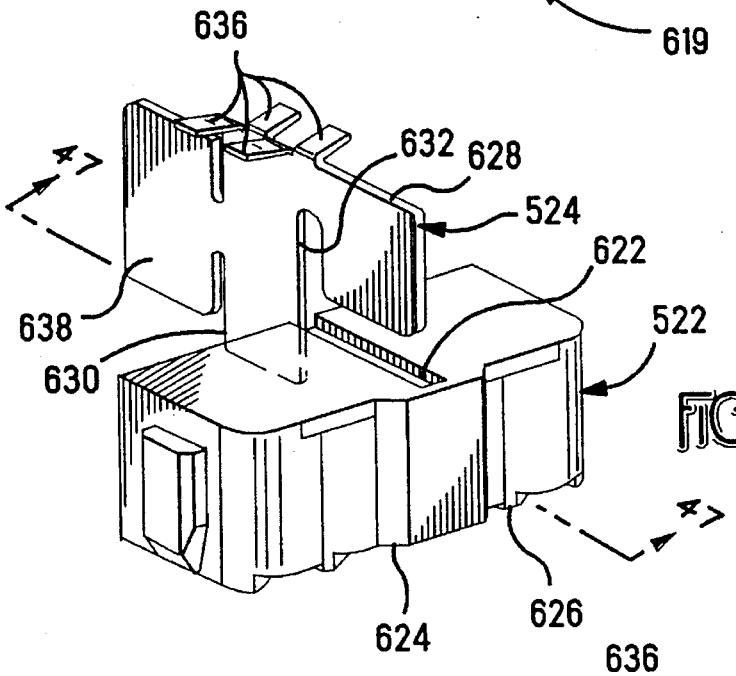
FIG. 46 illustrates the stuffer cap and central shield member portion of the connector of FIG. 45, illustrated from an oblique perspective view.
Figure 47:
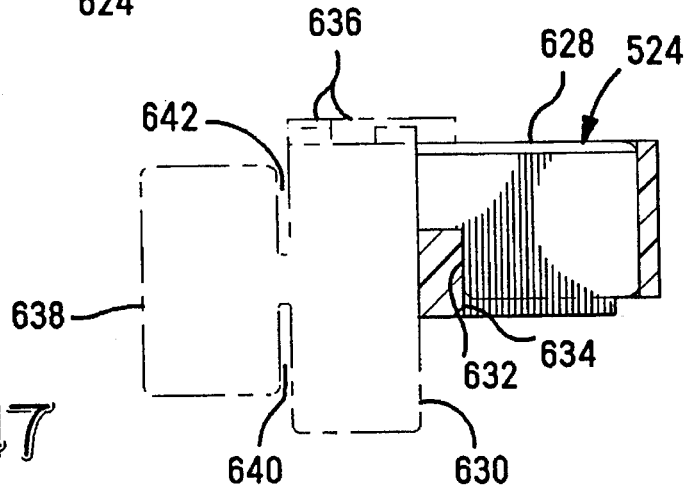
FIG. 47 depicts the stuffer cap of FIG. 46 along lines 47—47 of FIG. 3, in combination with the central shield member depicted in phantom representation.

Referring now also to FIGS. 46 and 47, therein it can be seen that stuffer cap 522 includes a generally centrally placed slot 622. Slot 622 is placed between central barrel receiving portions of stuffer cap 522, generally proximate the areas 624 and 626. These barrel receiving portions are, however, electrically isolated, through the body of stuffer cap 522, from slot 622. When connector 500 is assembled, central shield 524 will be placed in cooperative engagement with stuffer cap 522 through slot 622. Central shield 524 is a conductive member, preferably formed of sheet metal. Central shield 524 includes a front portion 628, which is separated from a central portion 630, having a greater vertical dimension, by a notch 632. Notch 632 is configured to fit over a rear web 634 extending across slot 622 in stuffer cap 522. Front portion 628 of central shield 524 is configured to extend proximate the entire vertical dimension of stuffer cap 522, when notch 632 engages web 634. Extending above a generally central portion of central shield 524 are a plurality of generally resilient tabs 636. Central shield 524, including tabs 636, is configured such that when connector 500 is assembled, tabs 636 will make mechanical and electrical contact with the lower side of upper shield 516, and the lower surface of central portion 630 will extend proximate the rear surface of terminal platform 540 and proximate lower shield 518.

In the depicted exemplary preferred embodiment of central shield 524, shield 524 includes a rear "rudder" portion 638, which extends from central portion 630, but which is flexibly arranged through upper and lower separation notches 640 and 642. The flexible attachment of rudder portion 638 to central portion 630 facilitates the bending, and resulting variable placement, of rudder portion 638 in any desired orientation relative to the termination of cable 526 in connector 500. This facilitates maintaining central shield 524 between pairs of signal carrying conductors 528, 530 regardless of the location at which cable 526 terminates in connector 500 (i.e., on a side, as depicted in FIG. 44, or axially, as generally depicted in FIG. 45.)

As depicted in FIG. 45, twisted pair conductors 528 and 530 extend beyond braided sheath 532 to facilitate their termination. Central shield 524 extends between the pairs of conductors to provide a ground potential shield therebetween to minimize cross-talk between the conductors. The engagement of tabs 636 with upper shield 516, serves to continue the ground potential shield of braided sheath 532 not only through the connector enclosure as formed by upper shield 516 and lower shield 518, but also to essentially surround each conductor pair within a ground potential enclosure through the interaction of central shield 524 with upper shield 516. The extension of front portion 128 of central shield 524 through stuffer cap 522 continues this enclosure of each conductor pair through the complete termination of the pair at the barrel portion 565 of each terminal.

Referring now to FIG. 48, therein is depicted a front view of terminal housing 520, lower shield 518 and lower body member 514. Electrical contact terminal end contact portions 562 each include a forwardly extending base portion 654 which is reversely bent proximate a forward extent 656 to form a resilient contact tongue 658. As can be seen from this view, terminal housing 520 includes a central slot 650 extending between the base portions 654 of terminal end contact portions 562. Slot 650 serves to establish an air gap between the terminals associated with each conductive pair, and to thereby reduce dielectric coupling between terminals. This reduction in dielectric coupling serves to further reduce signal cross-talk between the contact portions. Slot 650 may be extended rearwardly virtually any desired distance which is consistent with the strength of the material utilized for terminal housing 520 and the strength requirements for the connector. Preferably, slot 650 will extend rearwardly as close as possible to the forward most extension of central shield 524.

Many modifications and variations may be made in the techniques and structures described and illustrated herein without departing from the spirit and scope of the present invention. Accordingly, it should be readily understood that the techniques and structures described and illustrated herein are illustrative only, and are not to be considered as limitations upon the scope of the present invention.

We claim:

1. A shielded electrical connector comprising an insulative housing member having a terminal support platform having an open upper face;

a plurality of electrical contacts positioned along said platform, laterally positioned therealong;

said terminal support platform including a longitudinally extending rib upstanding from said platform and positioned between at least two of said contacts;

said rib including a longitudinally extending slot therein; and a cross talk shield positioned within said slot and within said rib intermediate said two contacts.

2. The connector of claim 1, wherein said rib totally insulates said cross talk shield along side surfaces thereof.

3. The connector of claim 1, wherein the slot is centrally located between at least two of said contacts.

4. The connector of claim 2, wherein the-slot is centrally located between at least two of said contacts.

5. The connector of claim 1, wherein said connector further comprises outer shielding, and said cross talk shield is electrically commoned to said outer shielding.

6. The connector of claim 2, wherein said connector further comprises outer shielding, and said cross talk shield is electrically commoned to said outer shielding.

7. The connector of claim 3, wherein said connector further comprises outer shielding, and said cross talk shield is electrically commoned to said outer shielding.

8. The connector of claim 5, wherein said cross shield is discrete from said outer shielding.

9. The connector of claim 6, wherein said cross shield is discrete from said outer shielding.

10. The connector of claim 7, wherein said cross shield is discrete from said outer shielding.

11. The connector of any of claims 1–10, wherein said slot opens downwardly through an outer lower surface of said housing.

12. The connector of any one of claims 5–10, wherein the outer shielding is comprised of an upper shield member and a lower shield member, the cross talk shield being commoned to said lower shield member.

13. The connector of claim 12, wherein the upper and lower shield members are commoned to each other, and to the cross talk shield member.

14. The connector of claim 12, wherein the cross talk shield is integral with said lower shield.

15. The connector of claim 13, wherein the cross talk shield is integral with said lower shield.

16. The connector of any one of claims 2–10, wherein the connector is a four position connector, having four contacts for receiving two pairs of twisted pair cable, the cross talk shield being positioned between two inner contacts.

17. The connector of claim 11, wherein the connector is a four position connector, having four contacts for receiving two pairs of twisted pair cable, the cross talk shield being positioned between two inner contacts.

18. The connector of claims 12, wherein the connector is a four position connector, having four contacts for receiving two pairs of twisted pair cable, the cross talk shield being positioned between two inner contacts.

19. The connector of claim 13, wherein the connector is a four position connector, having four contacts for receiving two pairs of twisted pair cable, the cross talk shield being positioned between two inner contacts.

20. The connector of claim 14, wherein the connector is a four position connector, having four contacts for receiving two pairs of twisted pair cable, the cross talk shield being positioned between two inner contacts.

21. The connector of claim 15, wherein the connector is a four position connector, having four contacts for receiving two pairs of twisted pair cable, the cross talk shield being positioned between two inner contacts.

22. A shielded electrical connector comprising:

an insulative outer shell carrying latching structure thereupon for connection to a mating component;

an insulative housing member receivable within the outer shell, said insulative housing including a terminal support platform having an open upper face with contact channels spaced laterally therealong and having a rib located between adjacent channels;

a plurality of electrical contacts laterally positioned along said platform where each contact is received within one of said channels;

where one of said ribs between two of the plurality of contacts includes a longitudinally extending slot therein; and a cross talk shield between said two contacts and that is positioned there by said slot in said rib.

23. The shielded connector of claim 22, further comprising a shield member configured such that when the shielding and the insulative housing are positionable within said outer shell such that said shield member is positioned between the insulative housing and the insulative outer shell.

24. The shielded connector of claim 23, wherein the shield member includes a first portion located below said housing and a second portion located above said housing, wherein said portions are commoned together and the cross talk shield is commoned therewith.

* * * * *